US007877056B2

(12) United States Patent
Yokoya et al.

(10) Patent No.: US 7,877,056 B2
(45) Date of Patent: Jan. 25, 2011

(54) IMAGE FORMING SYSTEM AND CONTROL METHOD FOR THE SAME

(75) Inventors: Takashi Yokoya, Kashiwa (JP); Ichiro Sasaki, Toride (JP); Mitsuhiko Sato, Kashiwa (JP); Hidenori Sunada, Toride (JP); Manabu Yamauchi, Kashiwa (JP); Naoto Watanabe, Abiko (JP); Takayuki Fujii, Tokyo (JP); Shunsuke Nishimura, Toride (JP); Akinobu Nishikata, Kashiwa (JP); Toshiyuki Miyake, Toride (JP)

(73) Assignee: Canon Kabushiki Kaisha (JP)

( * ) Notice: Subject to any disclaimer, the term of this patent is extended or adjusted under 35 U.S.C. 154(b) by 743 days.

(21) Appl. No.: 11/470,204

(22) Filed: Sep. 5, 2006

(65) Prior Publication Data

US 2007/0053733 A1 Mar. 8, 2007

(30) Foreign Application Priority Data

Sep. 6, 2005 (JP) ..... 2005-258306

(51) Int. Cl.
*G03G 15/00* (2006.01)

(52) U.S. Cl. ..... 399/407; 399/382

(58) Field of Classification Search ..... 399/407, 399/382

See application file for complete search history.

(56) References Cited

U.S. PATENT DOCUMENTS

| | | | | |
|---|---|---|---|---|
| 5,182,796 | A * | 1/1993 | Shibayama et al. | 715/841 |
| 6,608,974 | B2 * | 8/2003 | Kurita | 399/13 |
| 7,280,781 | B2 * | 10/2007 | Willis | 399/81 |
| 7,307,741 | B2 * | 12/2007 | Antinora | 358/1.12 |
| 2003/0035669 | A1 * | 2/2003 | Fujii et al. | 399/382 |
| 2005/0084277 | A1 * | 4/2005 | Kushida et al. | 399/81 |

FOREIGN PATENT DOCUMENTS

JP 2005-15225 A 1/2005

* cited by examiner

*Primary Examiner*—Anthony H. Nguyen
(74) *Attorney, Agent, or Firm*—Rossi, Kimms & McDowell LLP

(57) ABSTRACT

An image forming system comprises a selection unit for selecting a post-processing apparatus that executes post-processing to a recording medium on which an image is formed from among a plurality of post-processing apparatuses, and a selection limitation unit for determining an insertion apparatus whose supply of the insertion medium to be limited for a selected post-processing apparatus and limiting selection of the insertion apparatus.

10 Claims, 28 Drawing Sheets

FIG. 22A

| APPARATUS | FINISHER 700 | GLUING BOOKBINDER 500 | STACKER 400 | INSERTION DEDICATED APPARATUS 300 | IMAGE FORMING APPARATUS 10 |
|---|---|---|---|---|---|
| ID INFORMATION | ID4 | ID3 | ID2 | ID1 | ID0 |

FIG. 22B

| INSERTION APPARATUS / POST-PROCESSING APPARATUS | INSERTER 320 | INSERTER 520 | INSERTER 720 |
|---|---|---|---|
| FINISHER 700 | A | B | A |

FIG. 25A

| SELECTABILITY OF INSERTION APPARATUS / POST-PROCESSING APPARATUS | INSERTER 320 OF INSERTION DEDICATED DEVICE | INSERTER 520 OF BOOK-BINDING APPARATUS | INSERTER 720 OF FINISHER |
|---|---|---|---|
| BOOKBINDING APPARATUS 500 | SELECTABLE | SELECTABLE | NOT SELECTABLE |

FIG. 25B

| INSERTION APPARATUS / POST-PROCESSING APPARATUS | INSERTER 320 OF INSERTION DEDICATED DEVICE | INSERTER 520 OF BOOK-BINDING APPARATUS | INSERTER 720 OF FINISHER |
|---|---|---|---|
| BOOKBINDING APPARATUS 500 | A | A | – |

FIG. 25C

| INSERTION APPARATUS / POST-PROCESSING APPARATUS | INSERTER 320 OF INSERTION DEDICATED DEVICE | INSERTER 520 OF BOOK-BINDING APPARATUS | INSERTER 720 OF FINISHER |
|---|---|---|---|
| BOOKBINDING APPARATUS 500 | B | A | – |

FIG. 26A

| SELECTABILITY OF INSERTION APPARATUS / POST-PROCESSING APPARATUS | INSERTER 320 OF INSERTION DEDICATED DEVICE | INSERTER 520 OF BOOK-BINDING APPARATUS | INSERTER 720 OF FINISHER |
|---|---|---|---|
| FINISHER 700 | SELECTABLE | SELECTABLE | SELECTABLE |

FIG. 26B

| INSERTION APPARATUS / POST-PROCESSING APPARATUS | INSERTER 320 OF INSERTION DEDICATED DEVICE | INSERTER 520 OF BOOK-BINDING APPARATUS | INSERTER 720 OF FINISHER |
|---|---|---|---|
| FINISHER 700 | A | B | A |

FIG. 27A

| SELECTABILITY OF POST-PROCESSING APPARATUS / INSERTION APPARATUS | INSERTION DEDICATED APPARATUS 300 | BOOKBINDING APPARATUS 500 | FINISHER 700 |
|---|---|---|---|
| INSERTER 320 OF INSERTION DEDICATED APPARATUS | SELECTABLE | SELECTABLE | SELECTABLE |

FIG. 27B

| POST-PROCESSING APPARATUS / INSERTION APPARATUS | INSERTION DEDICATED APPARATUS 300 | BOOKBINDING APPARATUS 500 | FINISHER 700 |
|---|---|---|---|
| INSERTER 320 OF INSERTION DEDICATED APPARATUS | A | B | A |

FIG. 28A

| SELECTABILITY OF POST-PROCESSING APPARATUS / INSERTION APPARATUS | INSERTION DEDICATED APPARATUS 300 | BOOKBINDING APPARATUS 500 | FINISHER 700 |
|---|---|---|---|
| INSERTER 520 OF BOOKBINDING APPARATUS | NOT SELECTABLE | SELECTABLE | SELECTABLE |

FIG. 28B

| POST-PROCESSING APPARATUS / INSERTION APPARATUS | INSERTION DEDICATED APPARATUS 300 | BOOKBINDING APPARATUS 500 | FINISHER 700 |
|---|---|---|---|
| INSERTER 520 OF BOOKBINDING APPARATUS | – | A | A |

FIG. 28C

| POST-PROCESSING APPARATUS / INSERTION APPARATUS | INSERTION DEDICATED APPARATUS 300 | BOOKBINDING APPARATUS 500 | FINISHER 700 |
|---|---|---|---|
| INSERTER 520 OF BOOKBINDING APPARATUS | – | A | B |

IMAGE FORMING SYSTEM AND CONTROL METHOD FOR THE SAME

BACKGROUND OF THE INVENTION

1. Field of the Invention

The present invention relates to an image forming system that has an image forming apparatus for forming an image on a recording medium and a plurality of post-processing apparatuses that comprise an insertion apparatus for inserting insertion media among recording media, and a control method therefor.

2. Description of the Related Art

In recent years, with enhanced speed and improved image quality of image forming apparatuses using electrophotographic method and/or ink-jet printing apparatuses, a technique called print-on-demand (POD) has emerged that can handle a large number of copies or jobs.

In POD, printing operation and post-processing are performed in accordance with individual operator's needs in an office environment in which a finishing apparatus and the like capable of book binding and/or stapling is connected to an image forming apparatus.

In a conventional image forming system for application to POD that is composed of a plurality of apparatuses such as image forming apparatuses or post-processing apparatuses, the apparatuses transmit/receive data relating to printing jobs through communication among them to process a series of printing jobs including image formation and post-processing.

Japanese Patent Application Laid-Open No. 2005-15225 proposes the configuration of an image forming system that consists of an image forming apparatus main body and a number of post-processing apparatuses and allows one to select any post-processing function provided by a number of the post-processing apparatuses.

The Japanese Patent Application Laid-Open No. 2005-15225, however, does not disclose a configuration where a plurality of post-processing apparatuses equipped with insertion apparatuses that are capable of inserting recording media (hereinafter "sheets") are present in an image forming system. That is, the Japanese Patent Application Laid-Open No. 2005-15225 does not disclose a configuration for selecting an insertion apparatus that supplies sheets during execution of a selected post-processing function when post-processing for a printing job is set.

When an operator manipulates insertion of sheets individually from a plurality of insertion apparatuses in an image forming system, the operator has to determine any insertion apparatus that is limited in use by a selected post-processing function. When an operator performs manipulation separately for each printing job, there could be a problem of operational error. For example, if the operator selects an insertion apparatus that is positioned downstream of a post-processing apparatus selected as an apparatus for discharging sheets, the selection is inconsistent and thus result in an operational error.

There could also be a problem that a desired post-processing of a selected post-processing apparatus cannot be realized (i.e., productivity (or throughput) of an image forming system reduces) due to restriction of the processing ability of an insertion apparatus.

In an image forming system, arrangement of post-processing apparatuses may be changed. Thus, the operator has to be conscious of such a change when manipulating sheet insertion individually, which is inconvenient in terms of possible operational error or flexibility of system operation.

In view of such drawbacks, an object of the present invention is to provide an image forming technique that prevents operation error, has high productivity, and enables operation of a flexible image forming system.

SUMMARY OF THE INVENTION

According to the present invention, the foregoing object is attained by providing an image forming system that is configured by an image forming apparatus and a plurality of post-processing apparatuses attached thereto that comprise inserting apparatuses for supplying inserting media, the image forming system comprising:

a selection unit adapted to select a post-processing apparatus for executing a post-processing to the recording media from among the plurality of post-processing apparatuses; and a selection limitation unit adapted to determine any insertion apparatus to be limited in supply of the inserting media to the post-processing apparatus selected by the selection unit and limit selection of the insertion apparatus.

According to another aspect of the present invention, the foregoing object is attained by providing an image forming system that has an image forming apparatus for forming an image on a recording medium and a plurality of post-processing apparatuses that comprise insertion apparatuses for inserting an inserting medium to the recording medium, the image forming system controlling combination of the post-processing apparatuses and the insertion apparatuses in order to execute a post-processing selected for the recording medium that has been processed by the image forming apparatus, comprising:

a selection unit adapted to select an insertion apparatus that inserts the inserting medium; and a selection limitation unit adapted to determine any post-processing apparatus to be limited in processing when an insertion apparatus selected by the selection unit is used and limit selection of the post-processing apparatus.

Further features of the present invention will become apparent from the following description of exemplary embodiments with reference to the attached drawings.

BRIEF DESCRIPTION OF THE DRAWINGS

FIG. 22A shows identification information (ID0 to ID4) and positional relation among corresponding apparatuses in the image forming system;

FIG. 22B shows exemplary throughput data indicating productivity;

FIG. 25A shows exemplary result of selection limitation based on processing at S2301 of FIG. 23;

FIGS. 25B and 25C illustrate throughput data for each insertion apparatus when the bookbinding apparatus 500 serves as the post-processing apparatus;

FIG. 26A shows exemplary result of selection limitation based on processing at S2301 of FIG. 23;

FIG. 26B shows exemplary throughput data for each insertion apparatus when a finishing apparatus 700 serves as the post-processing apparatus;

FIG. 27A shows an exemplary result of selection limitation based on processing at S2401 of FIG. 24;

FIG. 27B shows exemplary throughput data for each post-processing apparatus when the insertion apparatus belongs to insertion dedicated apparatus 300;

FIG. 28A shows exemplary result of selection limitation based on processing at S2401 of FIG. 24; and FIGS. 28B and 28C show exemplary throughput data for each post-processing apparatus when the insertion apparatus belongs to the bookbinding apparatus 500.

DESCRIPTION OF THE EMBODIMENTS

First Embodiment

An image forming system according to an embodiment of the invention will be described below with reference to drawings.

(Overall Configuration of the Image Forming System)

Figure 1:
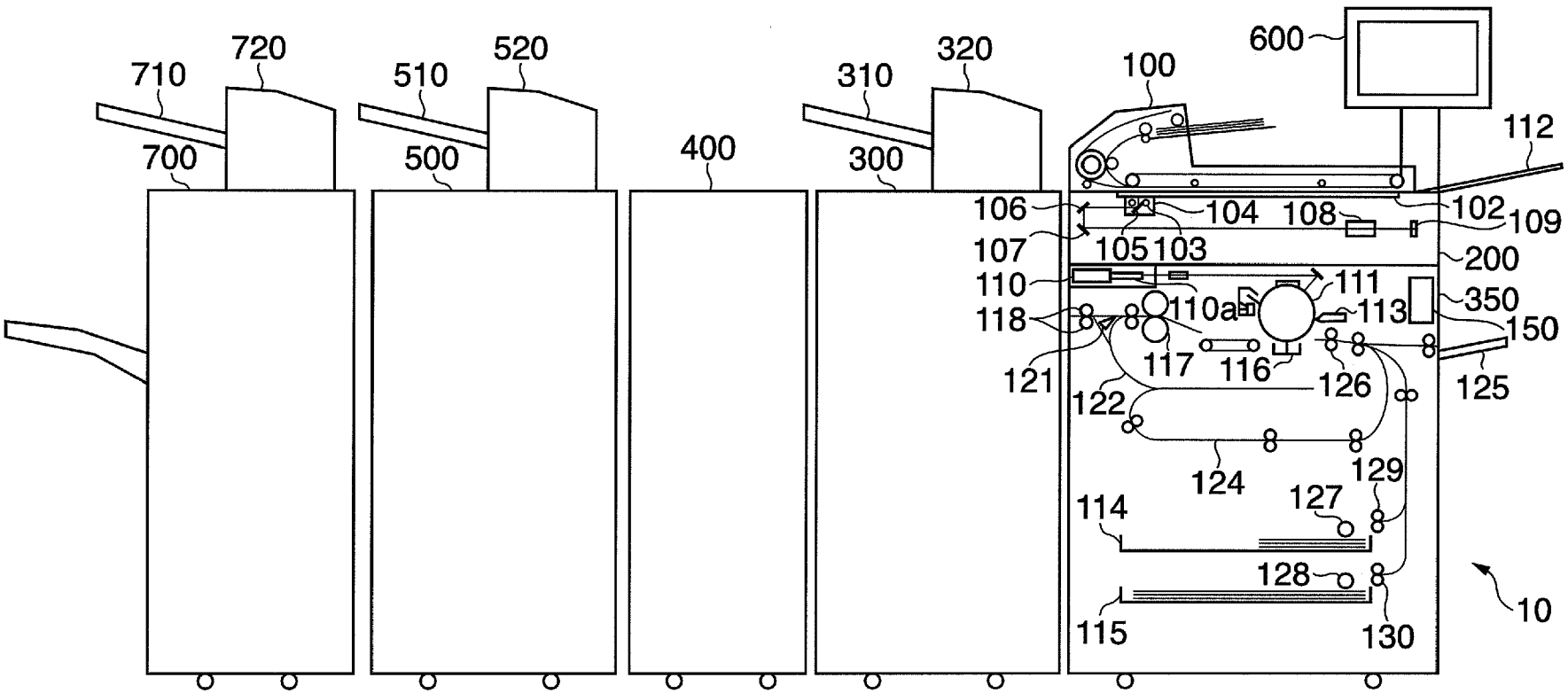
FIG. 1 shows primary components of an image forming system.

FIG. 1 shows major components of the image forming system. The image forming system is composed of an image forming apparatus 10 and a plurality of post-processing apparatuses (an insertion dedicated apparatus 300, a stacking apparatus 400, a gluing bookbinder (hereinafter also referred to as a "bookbinding apparatus") 500, and a finishing apparatus 700). The insertion dedicated apparatus 300 is equipped with an insertion apparatus (hereinafter also referred to as an "inserter") 320 that is capable of inserting sheets (i.e., insertion function) (hereinafter also called an "inserter") and the bookbinding apparatus 500 is equipped with an insertion apparatus (inserter) 520. The finishing apparatus 700 is equipped with an insertion apparatus (inserter) 720.

The image forming apparatus 10 has an image reader 200 for scanning images from documents and a printer 350 for forming scanned images on sheets.

Detailing the configuration of the image forming apparatus 10, the image reader 200 has a document feeder 100 thereon. The document feeder 100 supplies documents set on a document tray facing up in order from the top page one by one to the left in FIG. 1, and conveys them across a platen glass 102 from left to right over a sheet-through scanning position through a curved path, and then discharges them onto an external catch tray 112. When the document passes the sheet-through scanning position on the platen glass 102 from left to right, the image on the document is scanned in by a scanner unit 104 that is positioned corresponding to the sheet-through scanning position. This way of scanning is generally called document sheet-through scanning.

To be specific, when the document passes the sheet-through scanning position, a side of the document to be scanned is illuminated by light from a lamp 103 of the scanner unit 104, and reflected light from the document is guided to a lens 108 via mirrors 105, 106 and 107. After passing through the lens 108, the light is focused onto the image pick-up surface of an image sensor 109.

By conveying the document from left to right over the sheet-through scanning position in this manner, scanning of the document is conducted with the direction orthogonal to the direction of conveying the document as the main scanning direction and the conveying direction as the sub-scanning direction. That is, when the document passes the sheet-through scanning position, one line of document image is scanned in by the image sensor 109 in the main scanning direction, while the document is conveyed in the sub-scanning direction, thereby scanning in the entire image of the document.

The optically scanned image is converted to image data by the image sensor 109 and output. The image data output from the image sensor 109 is input as video signal to an exposure control unit 110 of the printer 350.

Alternatively, the document feeder 100 may convey the document onto the platen glass 102 and stop it at a predetermined position, in which position the document may be scanned by moving the scanner unit 104 from left to right. This way of scanning is so-called stationary document scanning.

When scanning a document without using the document feeder 100, the user first lifts up the document feeder 100 and places an document on the platen glass 102, and has the scanner unit 104 move from left to right to scan in the document. That is, when a document is scanned without using the document feeder 100, stationary document scanning is performed.

The exposure control unit 110 of the printer 350 modulates laser light in accordance with a video signal input from the image reader 200 and outputs the modulated laser light. The laser light is radiated onto a photosensitive drum 111 while being reciprocated by a polygon mirror 110a. On the photosensitive drum 111, an electrostatic latent image corresponding to the laser light is formed. Here, in stationary document scanning, the exposure control unit 110 outputs laser light so that a correct image (i.e., an image that is not a mirror image) is formed.

The electrostatic latent image on the photosensitive drum 111 is made visible as a developer image with developer supplied from a developing unit 113.

Meanwhile, a sheet fed from an upper paper feeding cassette 114 or a lower paper feeding cassette 115, which are mounted in the printer 350, by pick-up rollers 127 and 128 is conveyed to a registration roller 126 through paper-feeding rollers 129 and 130. When the edge of the sheet reaches the registration rollers 126, the registration rollers 126 are driven at an appropriate moment and, in synchronization of start of laser light irradiation, the sheet is conveyed to between the photosensitive drum 111 and a transfer unit 116. The developer image formed on the photosensitive drum 111 is transferred onto the supplied sheet by the transfer unit 116. The sheet having the developer image transferred thereon is conveyed to a fixing unit 117, which fixes the developer image onto the sheet by applying heat and pressure to the sheet. After passing through the fixing unit 117, the sheet is discharged toward the outside of the image forming apparatus main body (toward the post-processing apparatuses) from the printer 350 via a flapper 121 and discharge rollers 118.

Here, when the sheet is discharged with the side on which the image is formed facing down, the sheet that has passed the fixing unit 117 is guided once into a reversal path 122 through switching operation of the flapper 121. And after the rear end of the sheet passes the flapper 121, the sheet is switched back and discharged through the discharge rollers 118 from the printer 350. This form of sheet discharge is called reversed sheet discharge. Reversed sheet discharge is performed when image formation is made in order from the top page such as when images scanned in using the document feeder 100 are formed or when images output by a computer are formed, and sheets are discharged in a correct order of page number.

When a hard sheet such as an OHP sheet is fed from a manual paper feeding unit 125 and an image is formed thereon, the sheet is discharged by the discharge rollers 118 with the side bearing the formed image facing up, without being guided to the reversal path 122. When double-sided recording is set for forming images on both sides of a sheet, the sheet is further guided to the reversal path 122 with switching operation of the flappers 121. The sheet is subsequently conveyed to a double-sided conveying path 124, and from there, the sheet is controlled to be re-fed to between the photosensitive drum 111 and the transfer unit 116 at the timing described above.

The sheet discharged from the printer 350 of the image forming apparatus main body 10 is sent to the post-processing apparatuses.

(System Block Diagram)

Figure 2:
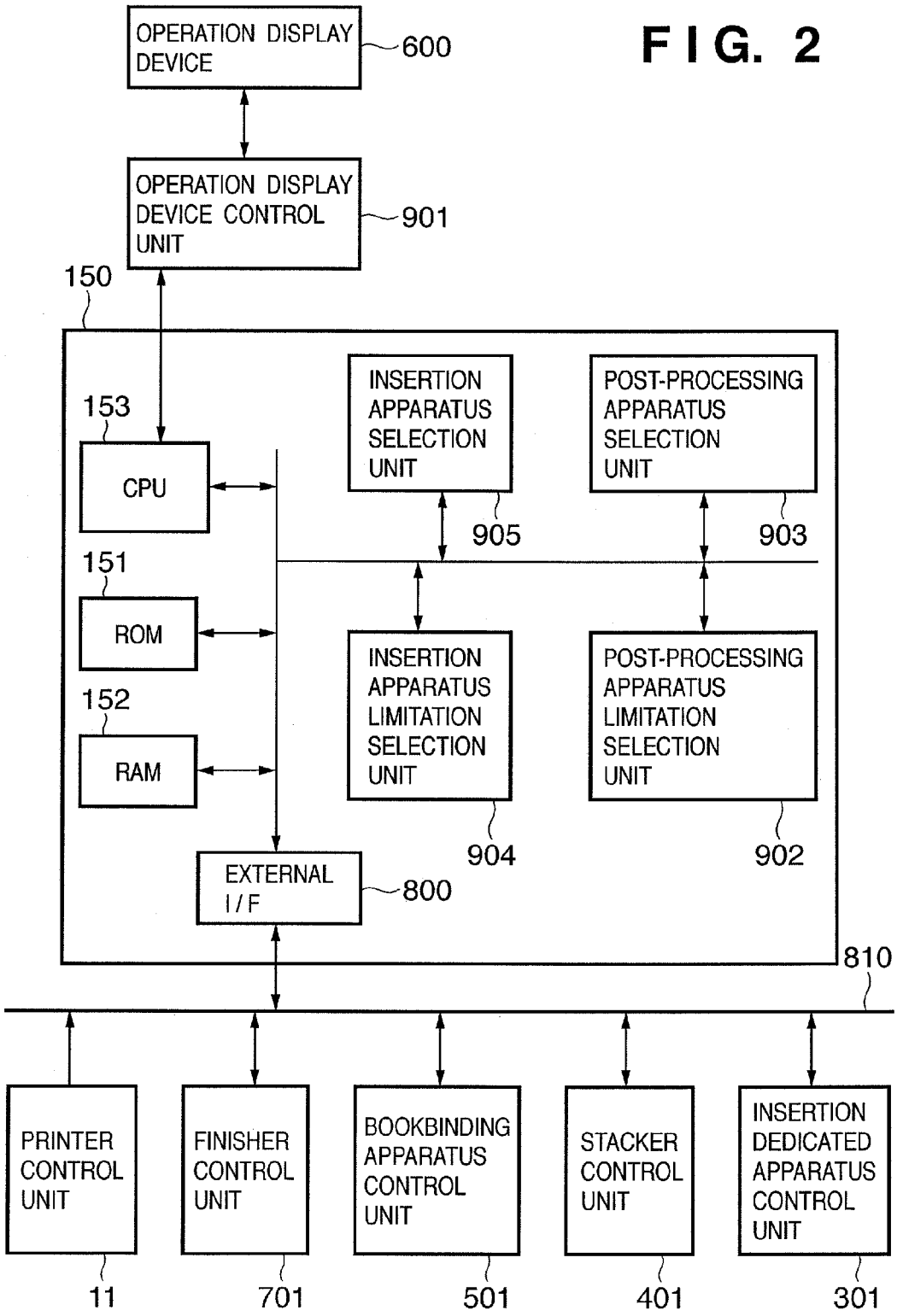
FIG. 2 is a block diagram showing the configuration of a control unit responsible for control of the entire image forming system.

FIG. 2 is a block diagram showing the configuration of the control unit 150 that is responsible for control of the entire image forming system shown in FIG. 1. The control unit 150 is provided inside the image forming apparatus 10 (FIG. 1.) The control unit 150 includes a CPU 153, ROM 151, and RAM 152.

The control unit 150 also includes a post-processing apparatus limitation selection unit 902, a post-processing apparatus selection unit 903, an insertion apparatus limitation selection unit 904, and an insertion apparatus selection unit 905. The post-processing apparatus limitation selection units (902 to 905) execute selection of a post-processing apparatus, selection of limitation on insertion apparatuses, selection of an insertion apparatus, and selection of limitation on post-processing apparatuses under the global control of the CPU 153.

The control unit 150 is capable of communicating with a printer control unit 11 and controlling the operation of the printer 350 by way of the printer control unit 11. The control unit 150 is connected to a network 810 via control units of the post-processing apparatuses 301, 401, 501, and 701 and an external I/F 800, communicating information via the external I/F 800 and controlling the image forming system centrally.

The control unit 150 can determine the operation state or setting condition of the post-processing apparatuses 300, 400, 500 and 700 from communication with the control units of the post-processing apparatuses 301, 401, 501 and 701.

The CPU 153 is capable of identifying the positional relationship among the apparatuses by communicating identification information indicating the type of an apparatus with the control units of the post-processing apparatuses 301, 401, 501, and 701. With this, the image forming apparatus can determine the positional relation of an apparatus that is positioned downstream from it (in FIG. 1, left side to the image forming apparatus 10). If arrangement of the post-processing apparatuses is changed in the image forming system, the image forming apparatus 10 can determine the arrangement of the apparatuses after the change from the order of identification information.

FIG. 22A illustrates pieces of identification information (IDO to ID4) obtained by the CPU 153. The identification information (IDO to ID4) enables determination of positional relationship among the corresponding apparatuses in the image forming system.

The RAM 152 temporally stores control data and is also used as a work area for computation associated with control. The RAM 152 also can store identification information communicated between the CPU 153 and the control units of the post-processing apparatuses 301, 401, 501, and 701 of or throughput data for the insertion apparatuses and post-processing apparatuses.

The CPU 153 can also communicate information on throughput of an apparatus (such as functions that can be executed by the apparatus and the number of sheets fed per unit time) with the control units of the post-processing apparatuses 301, 401, 501 and 701. The CPU 153 can evaluate productivity (throughput) based on information on throughput in relation to a selected post-processing apparatus or insertion apparatus.

FIG. 22B illustrates throughput data that indicates productivity. FIG. 22B shows throughput data for each of the inserters 320, 520 and 720 when the finishing apparatus 700 serves as the post-processing apparatus.

The figure shows that when the finishing apparatus 700 is selected, the throughput of the inserter 320 of the insertion dedicated device and the inserter 720 of the finishing apparatus is "A" (high level), thus combination of them and the finishing apparatus 700 will not reduce throughput.

On the other hand, the throughput of the inserter 520 of the bookbinding apparatus is "B" (medium level), which is lower than other inserters 320 and 720. It means that if the inserter 520 is selected in combination with the finishing apparatus 700, it can reduce the throughput on the finishing apparatus 700.

The throughput data may not be indicated as level units such as "A" and "B", but may be determined in terms of specific processing speed or the number of processable sheets. Alternatively, throughput data may be stored in the ROM 151 in advance and the post-processing apparatus limitation selection unit 902 and the insertion apparatus limitation selection unit 904 may reference the throughput data when executing selection limitation processing (S2302 in FIG. 23 and S2402 of FIG. 24)

Figure 20:
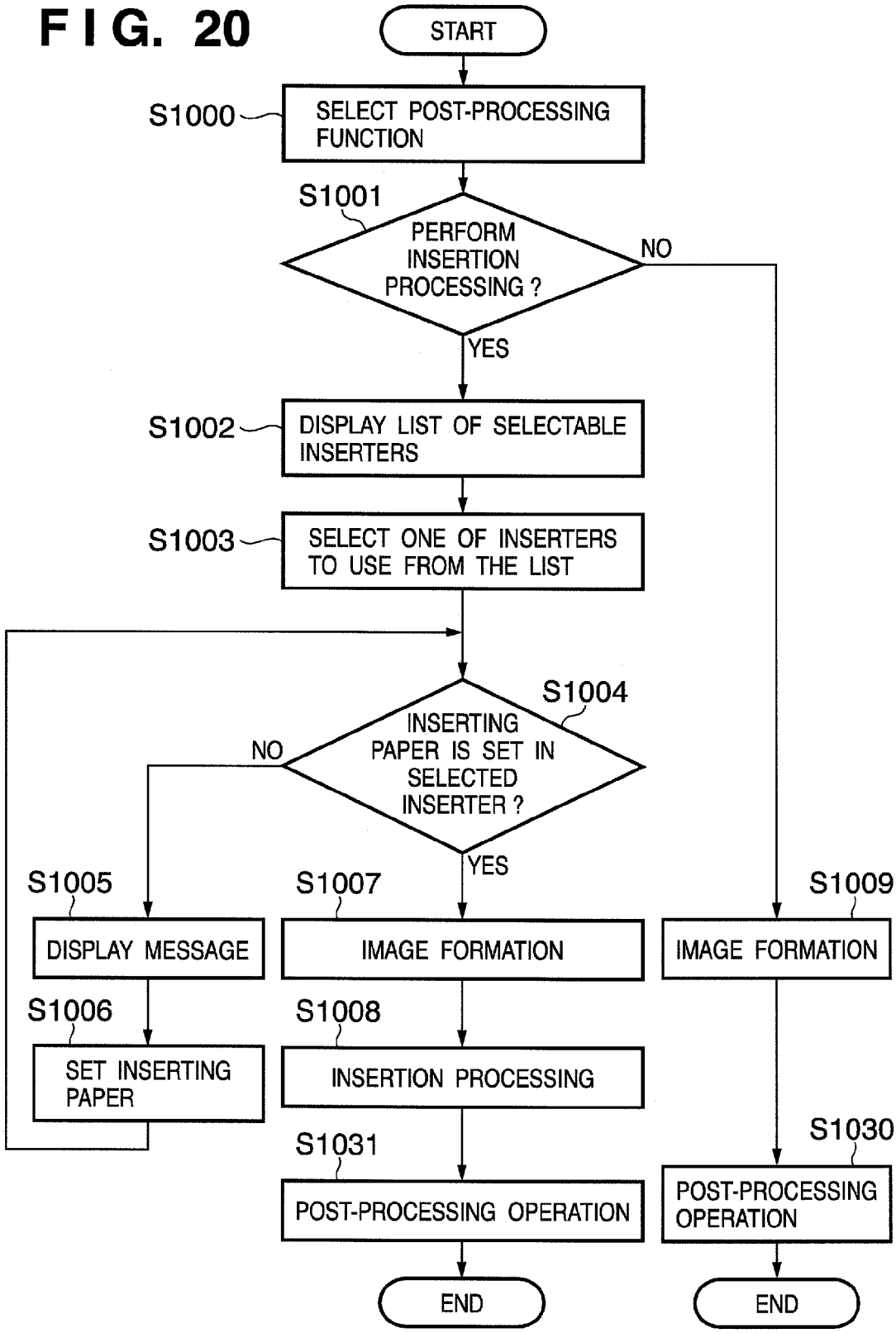
FIG. 20 is flowchart illustrating procedure of operation flow 1.

An operation display device control unit 901 exchanges information with an operation display device 600 and the CPU 153. The operation display device control unit 901 provides control of display associated with processing result and limitation of selection in the operation flows of FIGS. 20 and 21, which will be detailed later.

The operation display device 600 may have a plurality of keys for setting various functions relating to image formation, and a display unit for presenting information indicating setting conditions. The operation display device 600 is capable of outputting a key signal corresponding to operation of the keys to the CPU 153 and displaying corresponding information on the display unit based on a signal from the CPU 153.

The image forming system has the image forming apparatus 10 for forming images on sheets and the plurality of post-processing apparatuses 300, 500, 700 each having the inserters 320, 520, 720 for supplying inserting paper (inserting paper). The control unit 150 for controlling the image forming apparatus 10 includes the post-processing apparatus selection unit 903 and insertion apparatus limitation selection unit 904. The post-processing apparatus selection unit 903 selects a post-processing apparatus that performs post-processing to sheets processed by the image forming apparatus 10 from among the post-processing apparatuses. The insertion apparatus limitation selection unit 904 determines an insertion apparatus whose supply of inserting paper should be limited for a selected post-processing apparatus and limits selection of such insertion apparatuses.

Alternatively, the control unit 150 for controlling the image forming apparatus 10 may comprise the insertion apparatus selection unit 905 and the post-processing apparatus limitation selection unit 902.

The insertion apparatus selection unit 905 selects an insertion apparatus that supplies inserting paper. The post-processing apparatus limitation selection unit 904 uses the selected insertion apparatus to determine any post-processing apparatus that will be limited in execution and limits selection of that post-processing apparatus.

(Operation Display Unit)

Figure 3:
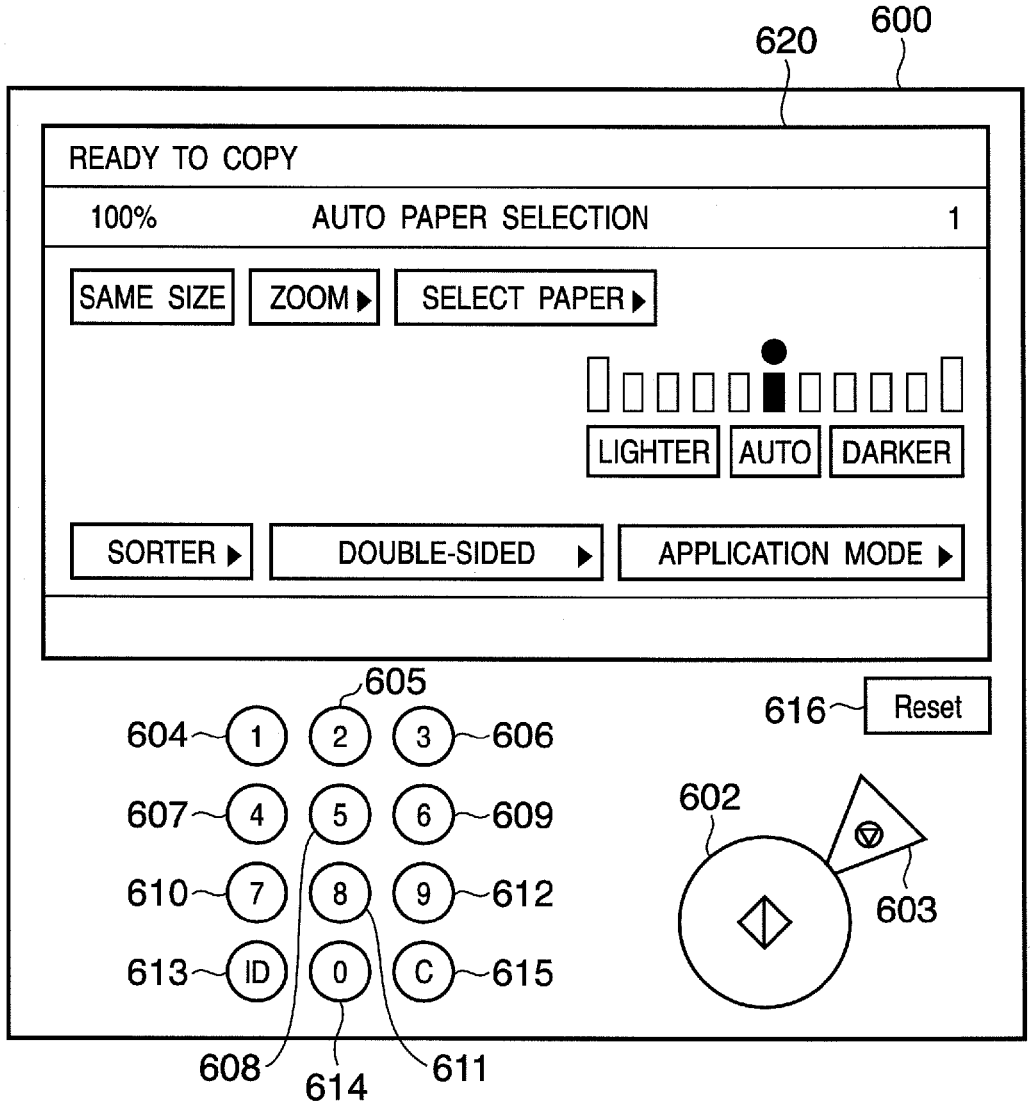
FIG. 3 shows operation display device 600 in the image forming system.

FIG. 3 shows the operation display device 600 in the image forming system of FIG. 1. On the operation display device 600, a start key 602 for initiating image forming operation, a stop key 603 for interrupting image forming operation, and numeric keys 604 to 612 and 614 for setting the number of copies or the like are positioned. Also positioned on the operation display device 600 are an ID key 613, a clear key 615, a reset key 616 and so on. In addition, a liquid crystal display portion 620 on which a touch panel is formed is provided in the upper portion, which enables creation of soft keys on the screen.

For example, the image forming system according to the embodiment has post-processing functions like stapling, sorting and bookbinding as post-processing functions provided by the post-processing apparatuses. These post-processing functions can be set through input operation from the operation display device 600.

(Operation Flow)

Operation flow associated with selection of a post-processing apparatus (i.e., post-processing function) and an insertion apparatus can be mainly divided into two flows (1) and (2) as follows:

(1) After selecting a post-processing function of the image forming system, an insertion apparatus is selected that can provide insertion processing to the post-processing apparatus that conducts the selected post-processing function (hereinafter this operation flow will be designated as "operation flow 1").

(2) After selecting an insertion apparatus, a post-processing function that can operate using the insertion apparatus is selected (hereinafter this operation flow will be designated as "operation flow 2").

Specific processing flows will be described below for the operation flows 1 and 2.

(Description of Operation Flow 1)

The procedure in operation flow 1 will be described with reference to flowcharts of FIGS. 20 and 23, and FIGS. 3 to 11. Various settings such as selection of a post-processing apparatus (i.e., post-processing function) and/or selection of an insertion apparatus for feeding inserting paper to sheets on which images are formed can be made on the display portion 620 of the operation display device 600 shown in FIG. 3.

(When "bookbinding" is selected as a post-processing function)

(Selection of a Post-Processing Function)

A case where "bookbinding" is selected as a post-processing function will be described as an example. When an operator selects an "application mode" key 412, which is a soft key, on the initial screen shown in FIG. 4, display changes to a screen for selecting an application mode 511 such as shown in FIG. 5. If the operator selects a soft key "bookbinding" 512 from the menu of application modes and presses "Next" 513, the post-processing apparatus selection unit 903 starts to configure an apparatus that corresponds to selection of bookbinding mode, which is one of post-processing functions. This processing corresponds to step S1000 of the flowchart in FIG. 20 (i.e., selection of a post-processing function).

The operation display device control unit 901 changes the screen of FIG. 5 to a screen for selecting a cover paper feeding tray (FIG. 6) on which paper supply for bookbinding/covering is set and processing proceeds to step S1001.

If inserting operation is not performed (No at S1001), processing proceeds to step S1009, where images are formed on sheets conveyed from the paper feeding cassettes 114 and 115 of the image forming apparatus 10. And bookbinding operation is carried out to the sheet processed at step S1009 (S1030).

(Selection of Limitation on Inserting Apparatuses (Inserters))

Selection of limitation on insertion apparatuses will be now described.

Figure 7:
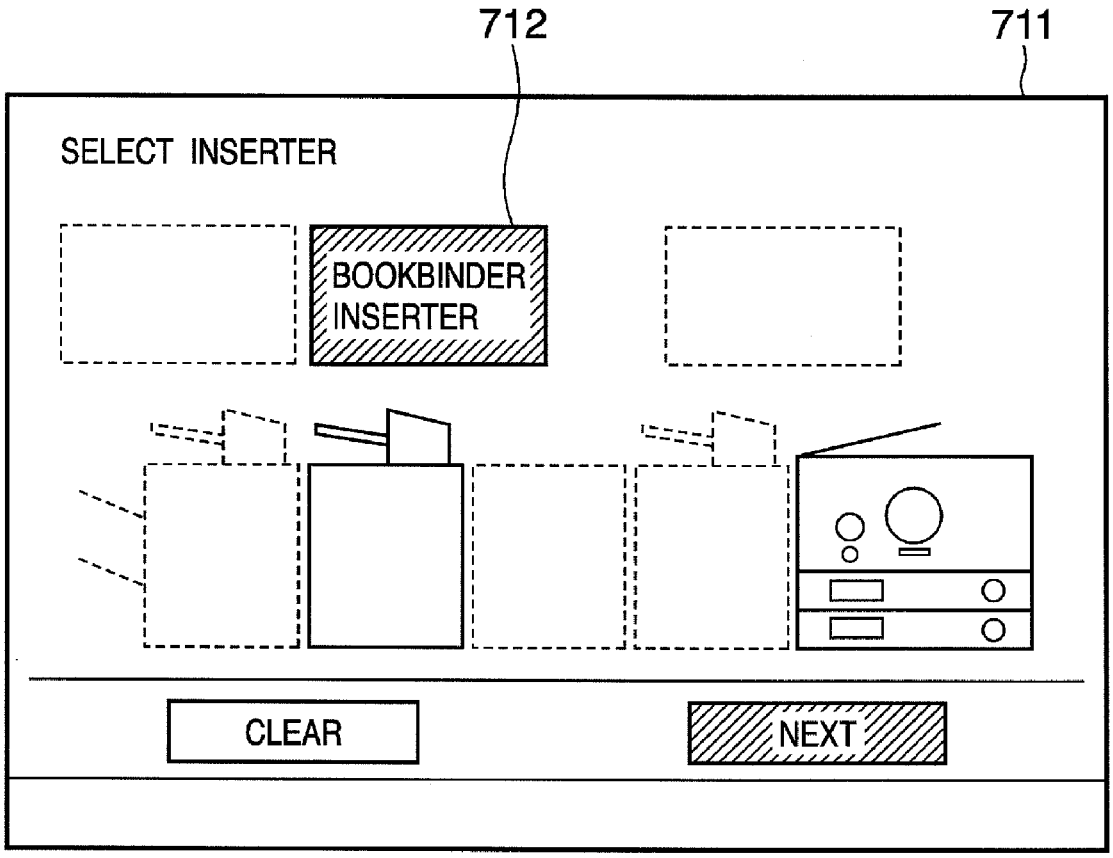
FIG. 7 shows a screen for selecting an insertion apparatus.

If a button 690 for specifying an insertion apparatus is selected at determination at step S1001 (YES at S1001), the operation display device control unit 901 changes the screen 601 to an insertion apparatus selection screen 711 (FIG. 7).

At step S1002, a list of selectable insertion apparatus is displayed on the screen. This display of the list is based on processing result at the insertion apparatus limitation selection unit 904.

(Processing by the Insertion Apparatus Limitation Selection Unit 904)

Figure 23:
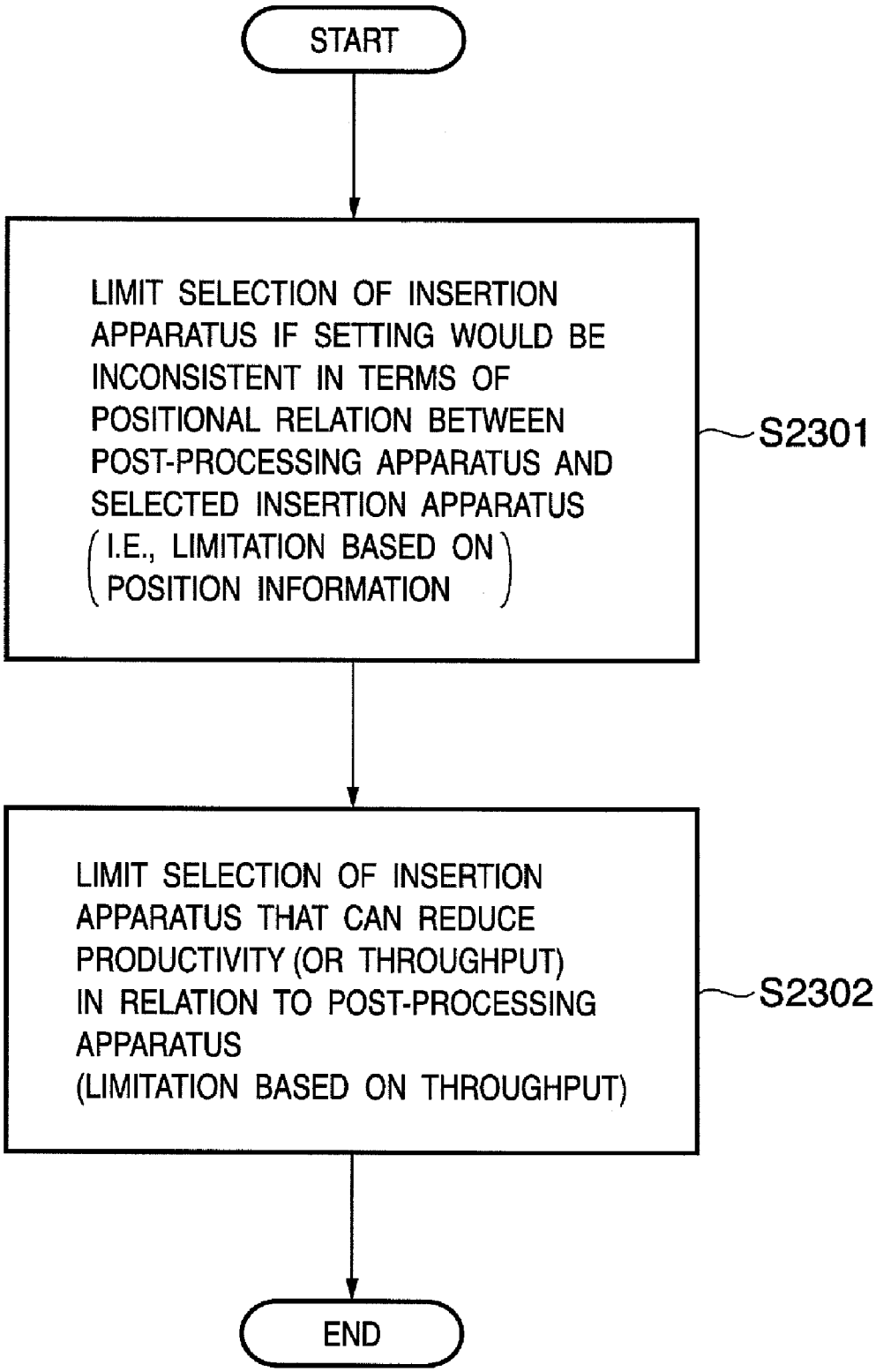
FIG. 23 is a flowchart illustrating processing of the insertion apparatus limitation selection unit 904.

The insertion apparatus limitation selection unit 904 executes processing for selecting limitation on insertion apparatuses in accordance with the flowchart in FIG. 23.

First, at step S2301, the insertion apparatus limitation selection unit 904 limits selection of an insertion apparatus if setting would be inconsistent in the positional relationship between the post-processing apparatus and the selected insertion apparatus (i.e., limitation based on position information).

At step S2302, the insertion apparatus limitation selection unit 904 limits selection of an insertion apparatus that may reduce productivity (throughput) in combination with the selected post-processing apparatus by referencing throughput data for each of the insertion apparatuses.

FIG. 25A shows a result of selection limitation based on processing at step S2301 of FIG. 23 as an example. For example, if the bookbinding apparatus (ID3) is selected as a post-processing apparatus in the positional relation shown in FIG. 22A, selection of an insertion apparatus of the finishing apparatus (ID4) that is positioned downstream from it would be a physically inconsistent setting, and thus selection of the insertion apparatus is limited. This limitation on selection can prevent an operation error that leads to an inconsistent setting.

FIGS. 25B and C illustrate throughput data for each insertion apparatus when the bookbinding apparatus 500 is selected as a post-processing apparatus. It is possible to evaluate productivity for combination of a selected post-processing apparatus and an insertion apparatus based on throughput data, and limitation on selection at S2302 of FIG. 23 is executed based on the data.

In FIG. 25B, when the bookbinding apparatus is selected, the inserter 320 of the insertion dedicated device and the inserter 520 of the bookbinding apparatus have throughput of "A" (high level), and throughput will not reduce in combination of them and the bookbinding apparatus. In this case, the insertion apparatus limitation selection unit 904 does not limit selection and identifies the inserter 320 and the inserter 520 of the bookbinding apparatus as selectable apparatuses.

Meanwhile, in the case of FIG. 25C, the inserter 520 of the bookbinding apparatus has throughput of "A" (high level), whereas that of the inserter 320 of the insertion dedicated apparatus is "B" (medium level), which is lower than the inserter 520. If the insertion dedicated apparatus is selected in combination with the bookbinding apparatus, it can reduce the throughput at the bookbinding apparatus. In this case, the insertion apparatus limitation selection unit 904 limits selection of the inserter 320 and identifies the inserter 520 of the bookbinding apparatus 500 as a selectable insertion apparatus. This can limit selection that leads to reduced productivity (throughput).

Based on the identification, only the inserter 520 of the bookbinding apparatus is indicated as a selectable apparatus on the selection screen 711 of the insertion apparatus of FIG. 7 (712).

(When "stapling" is Selected as a Post-Processing Function)

(Selection of Post-Processing Function)

A case where "stapling" is selected as a post-processing function will be described below. A post-processing function can be selected in the same way as with "bookbinding" described above. Initially, when the operator selects the "application mode" key 412, which is a soft key, on the initial screen of the display portion 620 shown in FIG. 4, display changes to the screen for selecting an application mode 511 such as shown in FIG. 5. When a soft key "stapling" 514 is selected from the application mode menu and "Next" 513 is pressed, setting of stapling mode is started.

After the post-processing function is selected, processing proceeds to step S1001, where the operator determines whether to perform inserting processing or not. If insertion processing is not performed (NO at S1001), processing proceeds to step S1009 (image formation) and S1030 (post-processing operation) as in "bookbinding" setting.

However, when insertion processing is performed (YES at S1001), the screen is changed to a screen showing a list of selectable insertion apparatuses (S1002).

(Selection of Limitation on Insertion Apparatuses (Inserters))

At step S1002, a list of selectable insertion apparatuses is displayed on the screen. This display of the list is based on the result of processing at the insertion apparatus limitation selection unit 904.

FIG. 26A shows a result of selection limitation based on processing at S2301 of FIG. 23 as an example. Since no apparatus is positioned downstream from the finishing apparatus (ID4) when the apparatus is selected as a post-processing apparatus in the positional relation shown in FIG. 22A, selection of any insertion apparatus would not result in physically inconsistent setting, thus selection is not limited based on position information.

FIG. 26B shows an example of throughput data for each insertion apparatus when the finishing apparatus 700 is selected as a post-processing apparatus. Productivity for combination of the selected post-processing apparatus and an insertion apparatus can be evaluated based on throughput data, and limitation on selection at S2302 of FIG. 23 is executed based on the data.

In FIG. 26B, if the finishing apparatus is selected, the inserter 320 of the insertion dedicated apparatus and the inserter 720 of the finishing apparatus have both throughput of "A" (high level), thus combination of either of them and the finishing apparatus will not reduce throughput.

On the other hand, the inserter 520 of the bookbinding apparatus has throughput of "B" (medium level), thus has lower throughput. If the inserter 520 of the bookbinding apparatus is selected in combination with the finishing apparatus, it can reduce the throughput at the finishing apparatus.

In this case, the insertion apparatus limitation selection unit 904 limits selection of the inserter 520 and identifies the inserters 320 and 720 that will not reduce throughput as selectable insertion apparatuses. This can prevent selection that leads to decreased productivity (throughput).

Figure 8:
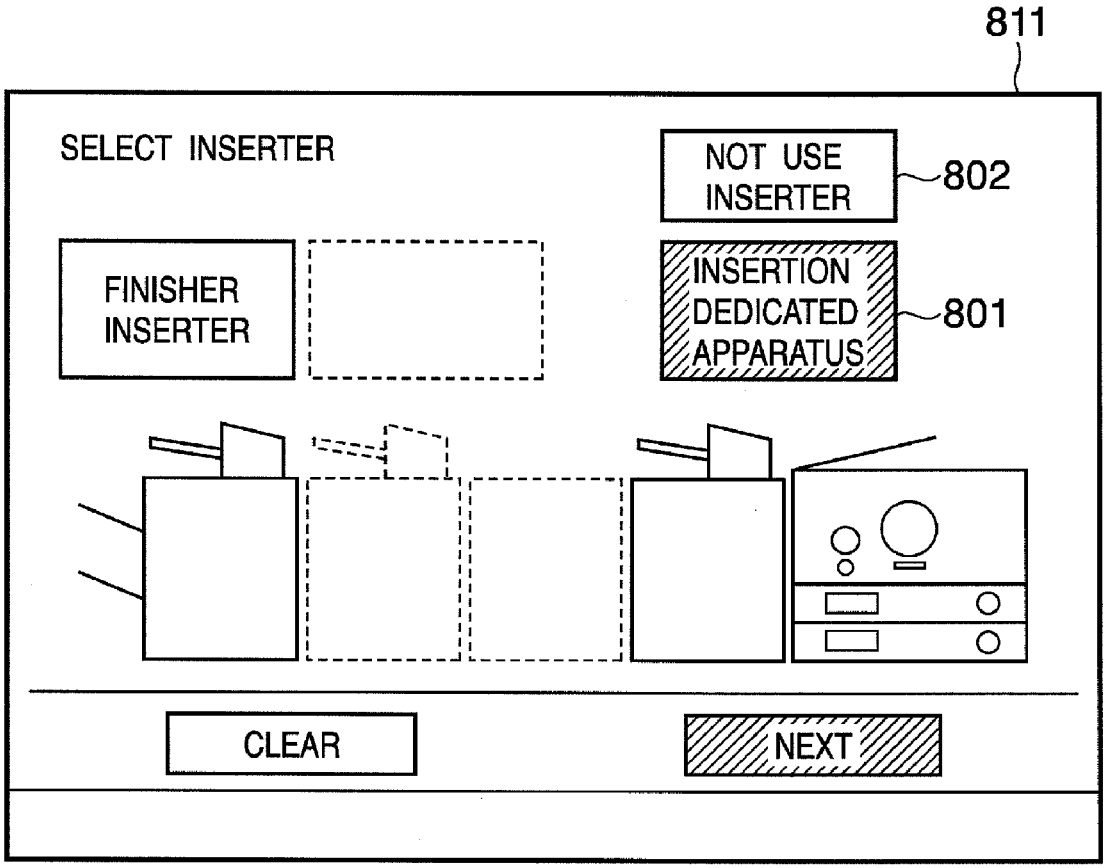
FIG. 8 shows a screen for selecting an insertion apparatus.
Figure 9:
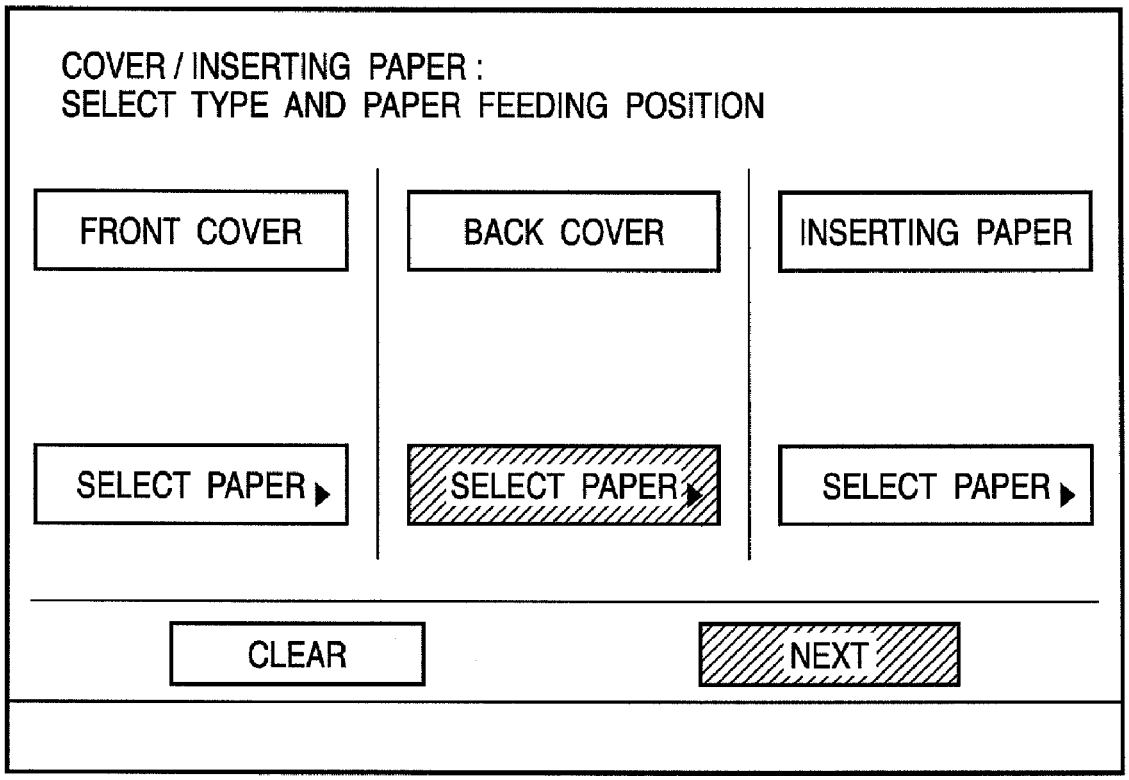
FIG. 9 shows a screen for selecting a paper feeding position.

Based on the identification, the inserters 320 and 720 are indicated as selectable apparatuses on the insertion apparatus selection screen 811 shown in FIG. 8.

Returning to FIG. 20, at step S1003, one of the insertion apparatuses is selected in the list of FIG. 8. Here, the inserter 320 of the insertion dedicated apparatus is selected. As a result of this selection, display of the insertion dedicated device becomes highlighted, indicating that this is the selected apparatus (801).

If "Not use an inserter" button 802 is pressed in FIG. 8, no insertion apparatus is used and only image formation and processing by the finishing device is carried out. This processing is same as processing at steps S1009 and S1030 described earlier.

(Setting of sheet insertion)

Figure 10:
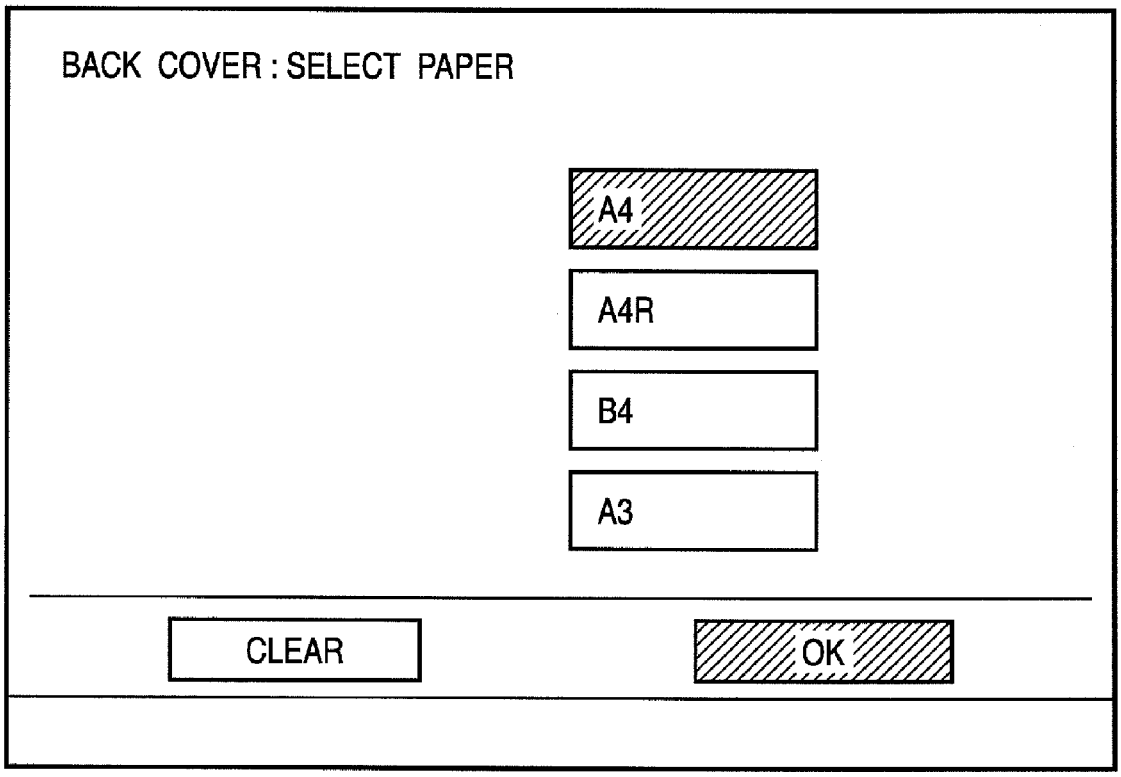
FIG. 10 shows a screen for selecting a paper size.
Figure 11:
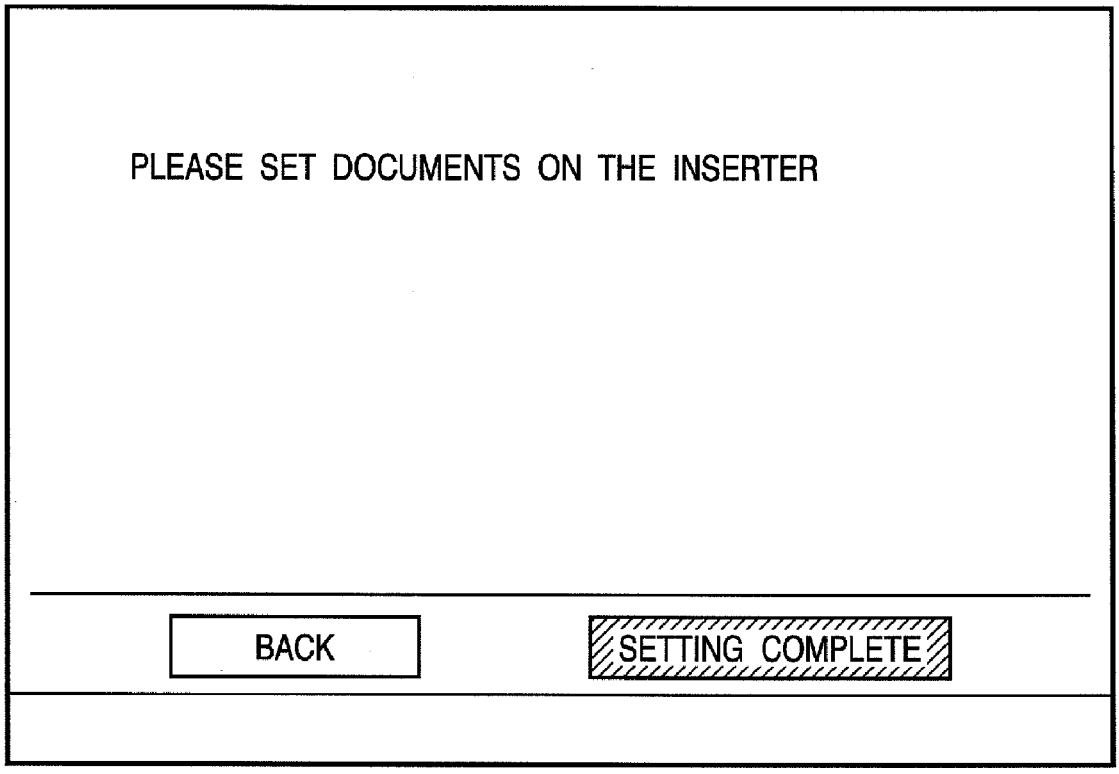
FIG. 11 shows an example of a warning message displayed on the display.

After one of the listed insertion apparatuses is selected at step 31003, the operator selects a paper feeding position at which inserting paper set in the selected insertion apparatus is fed. The selection screen of FIG. 9 displays buttons for selecting from cover/back cover/inserting paper, so that the operator can select one of the paper feeding positions. After a paper feeding position is selected (in FIG. 9, back cover is selected), the size of inserting paper (A4, A4R, B4, or A3) is selected next (FIG. 10). FIG. 10 shows that A4 size has been selected. When paper feeding position and insertion paper size have been selected, setting of inserting paper is complete.

(Preparation of Inserting Paper)

When setting of inserting paper is complete, processing proceeds to step S1004, where the CPU 153 determines whether inserting paper is already set in the selected insertion apparatus. If inserting paper is not set (No at S1004), the operation display device control unit 901 has the operation display device 600 display a message (FIG. 11) that prompts the operator to set inserting paper in the selected insertion apparatus (S1005).

After the operator sets inserting paper (S1006) and presses the start key 602 on the operation display device 600, preparation is complete (YES at S1004) and processing proceeds to step S1007. If inserting paper is already set at the point processing proceeds from step S1003 to step S1004 (YES at S1004), processing proceeds to step S1007.

At step S1007, the image forming apparatus 10 executes image formation processing, at step S1008 insertion processing is executed by the selected insertion apparatus, and at step S1031, operation of selected post-processing is executed. With the processing, the operation flow 1 completes.

According to the embodiment, it is possible to provide an image forming technique that prevents operation error, has high productivity, and enables operation of an image forming system with flexibility.

It is also possible to provide an image forming system that can limit selection of an insertion apparatus that will be limited in use in relation to a selected post-processing function and allow one to select an available insertion apparatus.

Second Embodiment

Procedure of operation flow 2 will be described below as the second embodiment of the invention. As the configuration of the image forming system constituting the embodiment is the same as in the first embodiment, description on it is omitted here.

The following will describe the procedure of operation flow 2 in which, after an insertion apparatus is selected, a post-processing function that can operate using the insertion apparatus is selected, with reference to the flowchart of FIG. 21 and FIGS. 12 to 19. Various settings such as selection of a post-processing function to use and/or selection of an insertion apparatus for supplying inserting paper can be made on the display portion 620 of the operation display device 600 shown in FIG. 3 as in operation flow 1.

Figure 4:
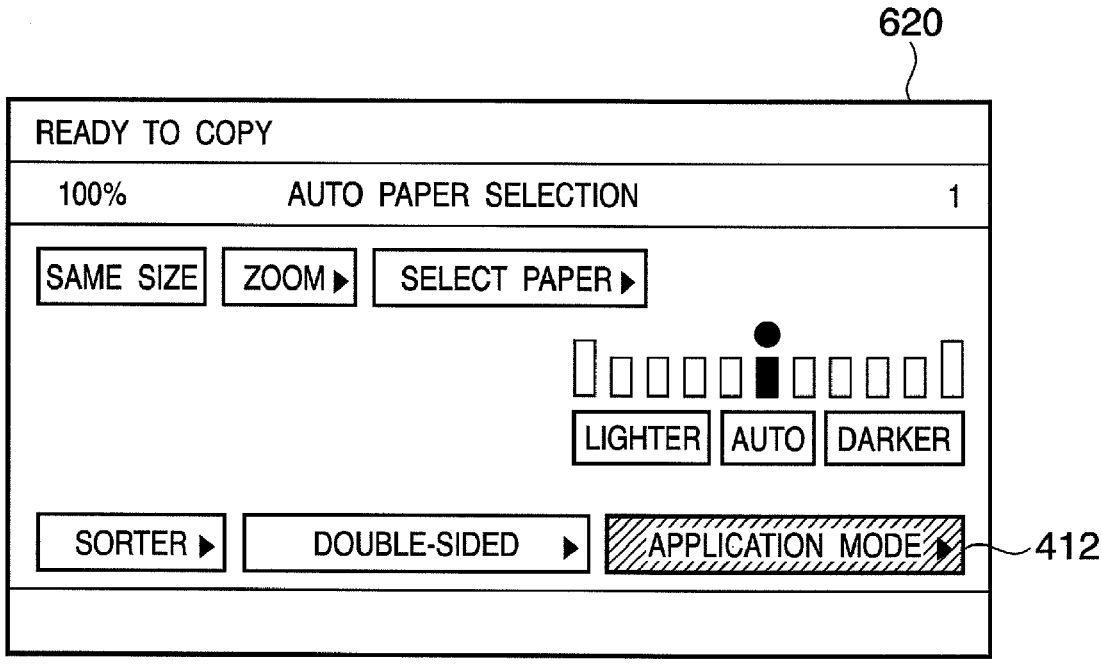
FIG. 4 shows the initial screen of the display portion 620.
Figure 5:
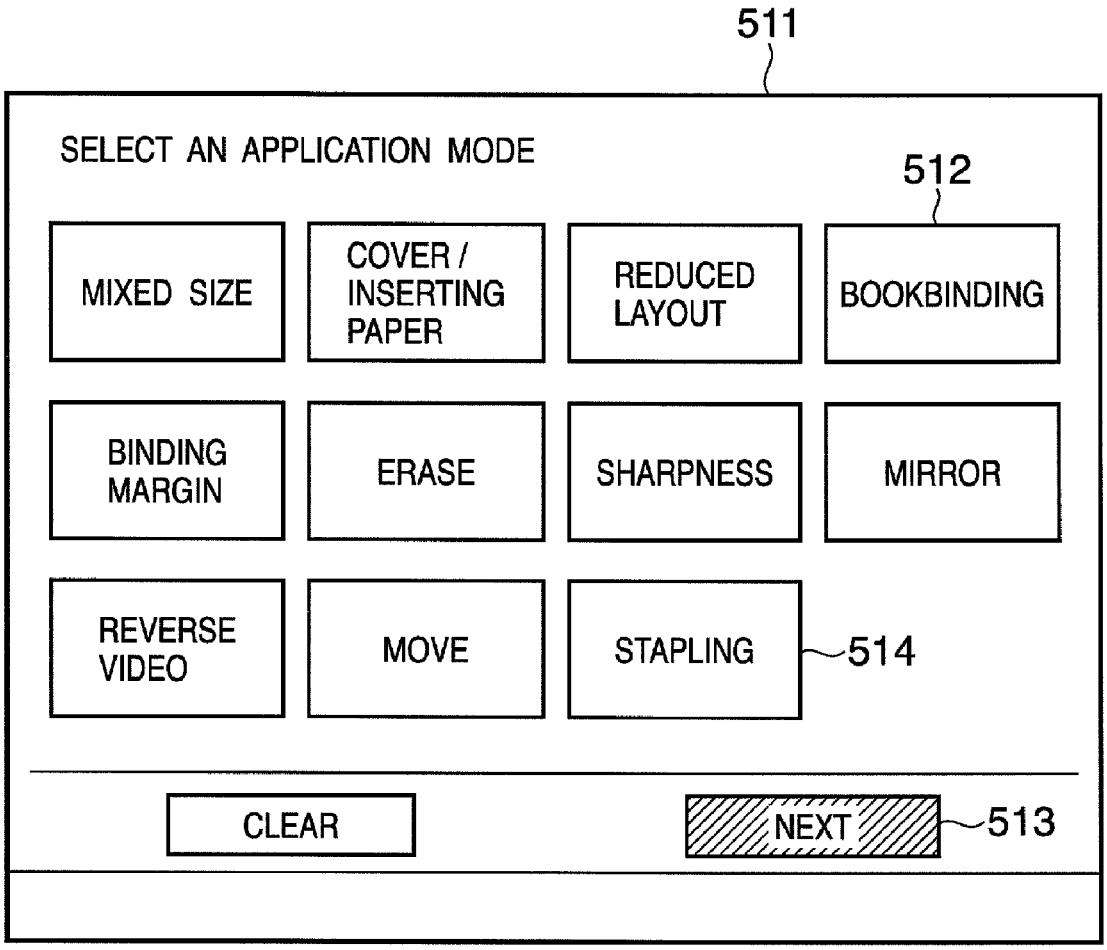
FIG. 5 shows a screen for selecting an application mode.
Figure 6:
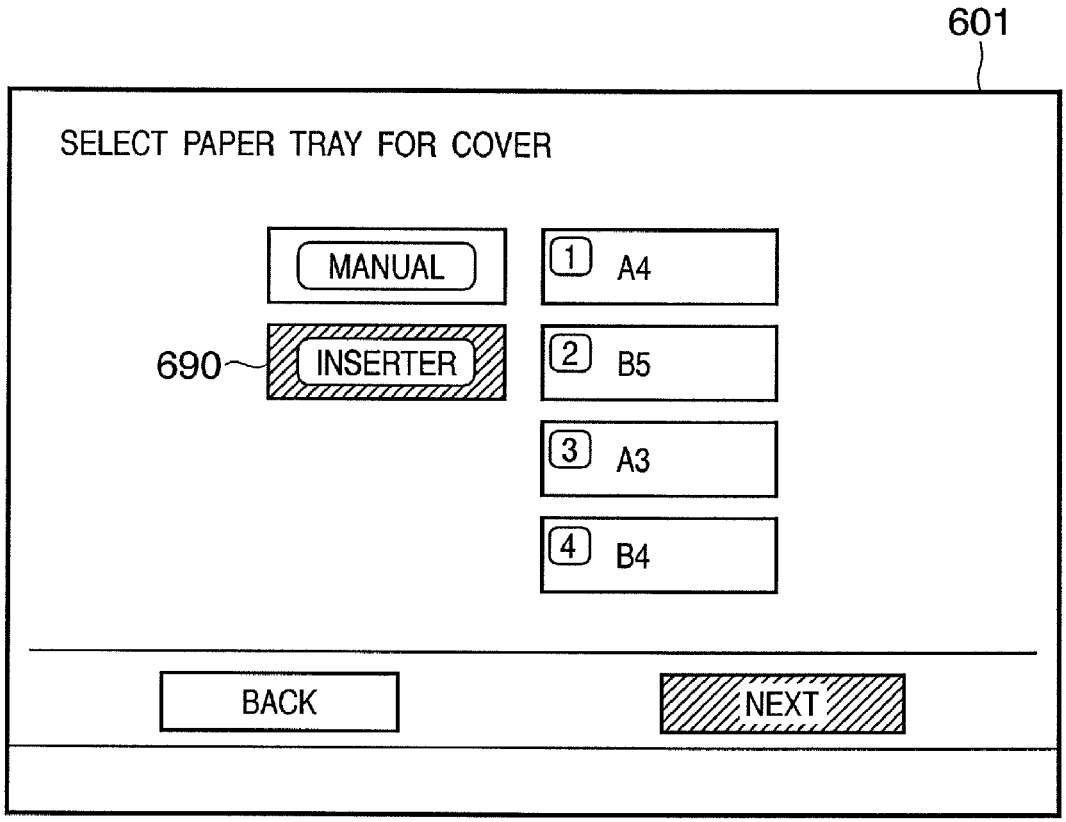
FIG. 6 shows a screen for selecting a cover paper feeding tray.
Figure 12:
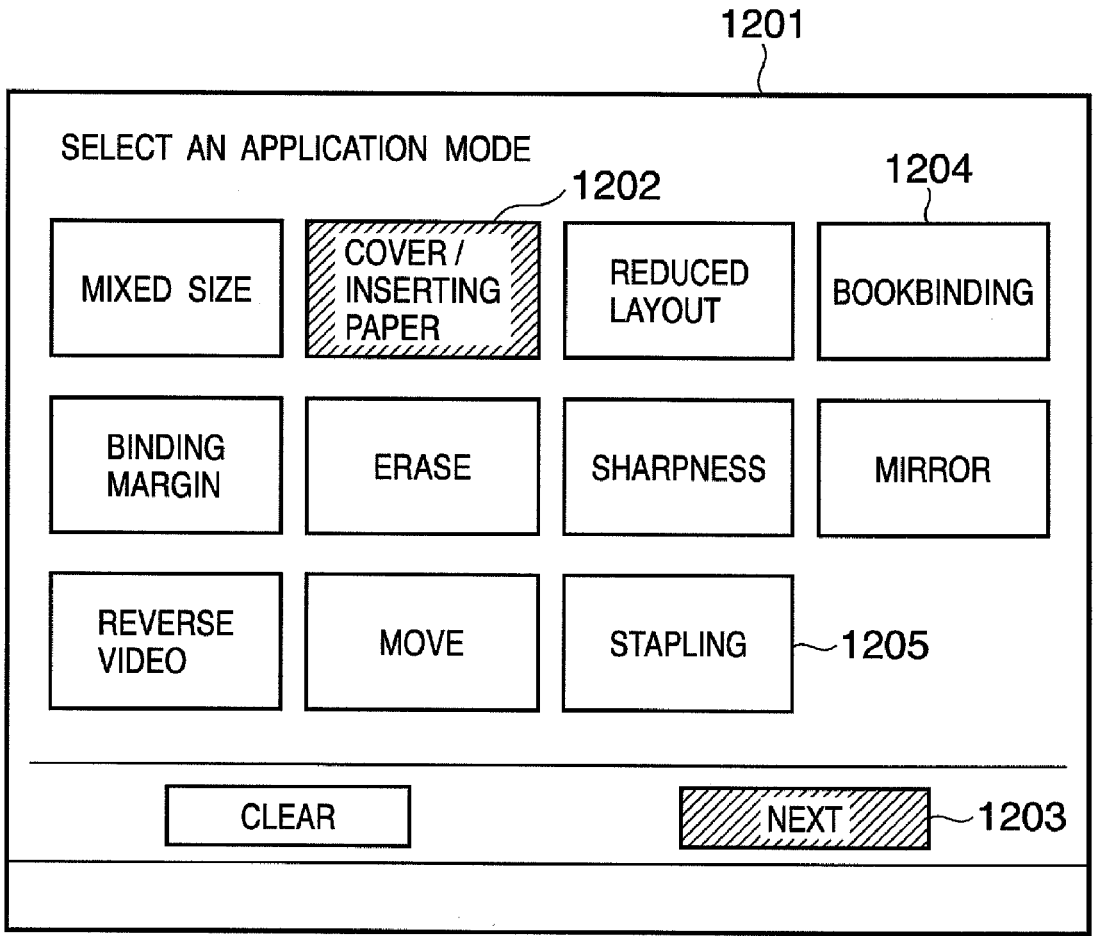
FIG. 12 shows a screen for selecting an application mode.

When the operator selects the "application mode" key 412, which is a soft key, on the initial screen shown in FIG. 4, display changes to a screen 1201 for selecting an application mode such as shown in FIG. 12. The operator determines whether to use an insertion apparatus for supplying inserting paper from the application mode menu. This processing corresponds to step S1010 of the flowchart in FIG. 21.

If the operator decides not to use an insertion apparatus (No at S1010), processing proceeds to step S1019, where the operator selects a post-processing function. At step S1020, image formation is made on a sheet conveyed from the paper feeding cassettes 114 and 115 of the image forming apparatus 10 (S1020). And the post-processing operation selected at the previous step S1019 is performed on the sheet that has been processed at step S1020 (S1032).

(Selection of an Insertion Apparatus)

Figure 13:
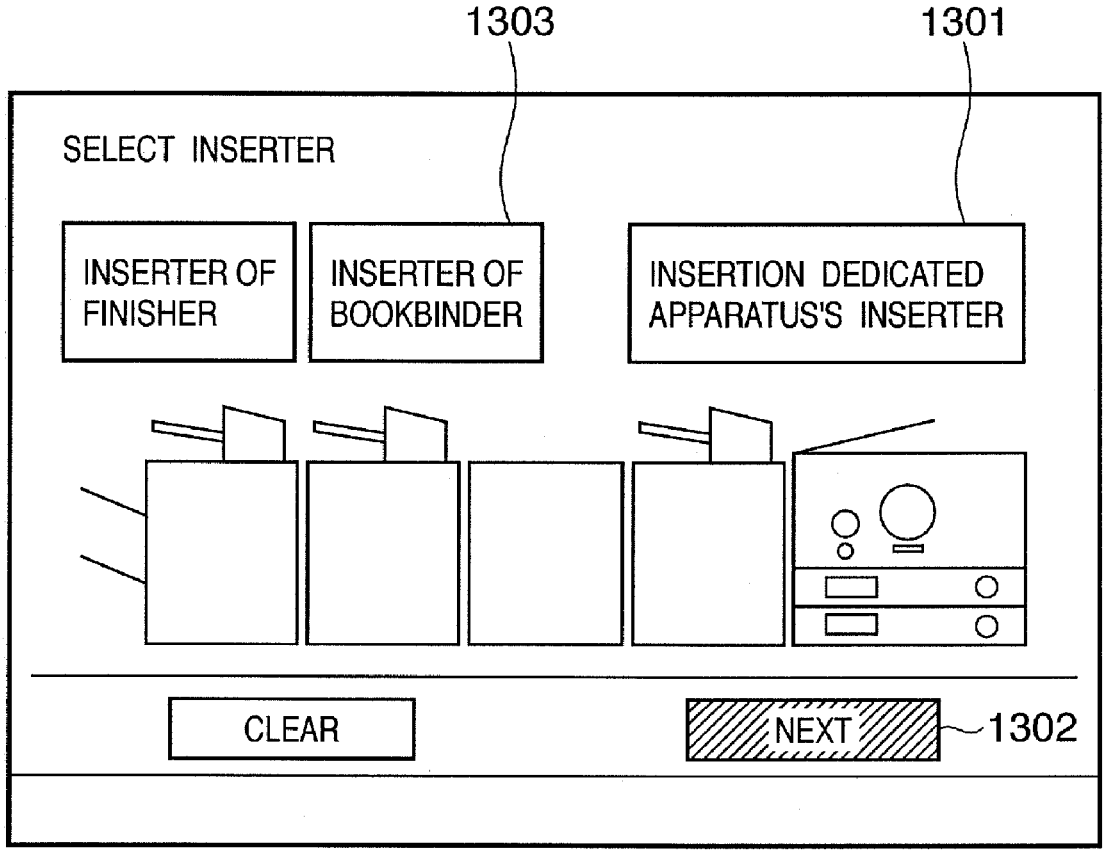
FIG. 13 shows a screen for selecting an insertion apparatus.
Figure 14:
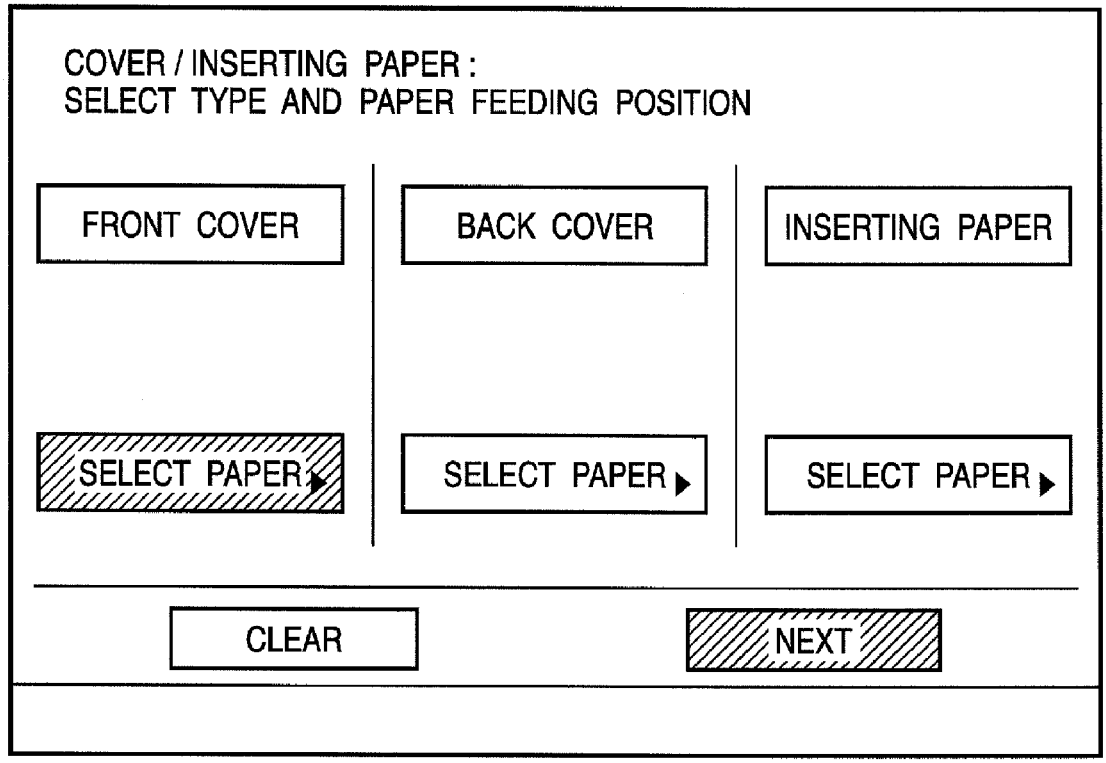
FIG. 14 shows a screen for selecting a paper feeding position.

Meanwhile, in FIG. 12, when "cover/inserting paper" 1202, which is post-processing functions realized using an insertion apparatus, is selected and a soft key "Next"; 1203 is pressed (YES at S1010), processing proceeds to step S1011. The application mode selection screen of FIG. 12 changes to the insertion apparatus selection screen shown in FIG. 13. Since in this case no post-processing function is selected other than cover/inserting paper unlike the operation flow 1 describe earlier, there is no limitation by a post-processing function at this point and all insertion apparatuses that are present in the image forming system can be selected. In FIG. 13, selectable insertion apparatuses are all indicated with solid line.

(When Inserter 320 is Selected)

Figure 15:
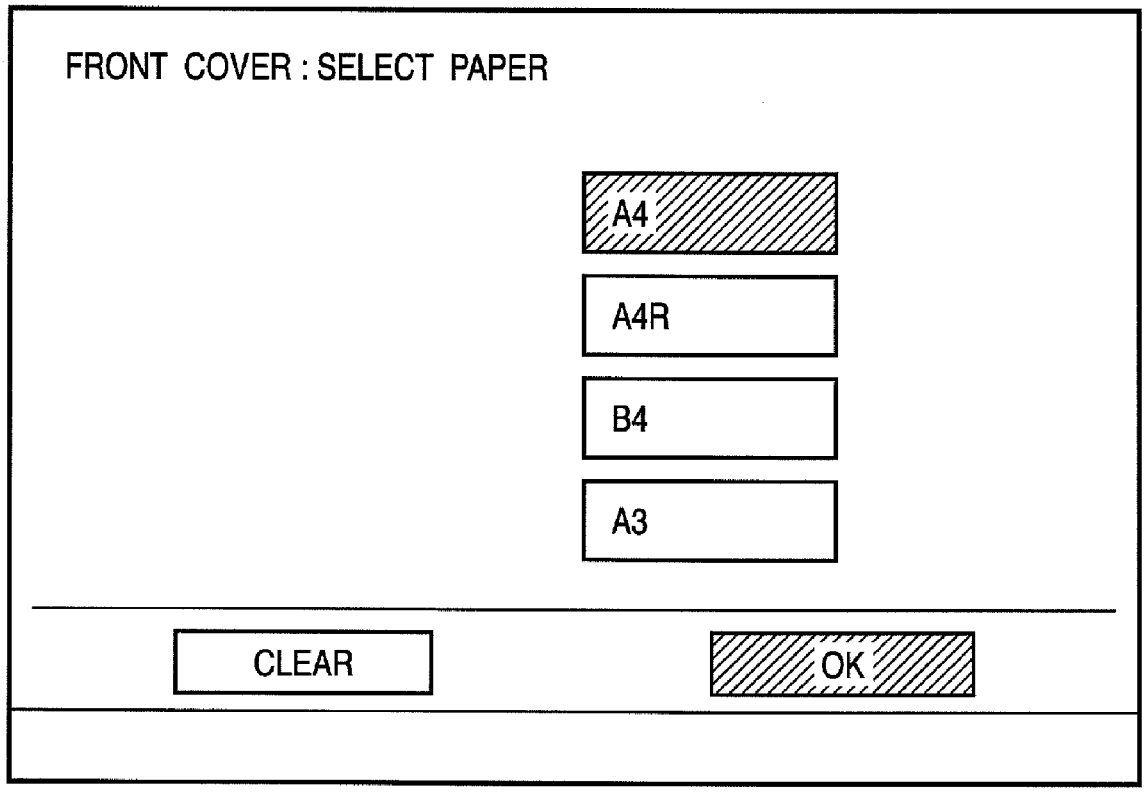
FIG. 15 shows a screen for selecting a paper size.

In accordance with selecting operation by the operator, the insertion apparatus selection unit 905 executes processing associated with selection and setting of an insertion apparatus. The description here will refer to a case the inserter 320 of an insertion dedicated apparatus is selected (S1011). In FIG. 13, when the operator selects the inserter 320 (1301) and presses "Next" button 1302, display changes to a screen (FIG. 14) for setting a position at which inserting paper is fed. The selection screen of FIG. 14 displays buttons for selecting from front cover/back cover/inserting paper, so that the operator can select one of the paper feeding positions. After selecting a paper feeding position ("front cover" is selected in FIG. 14), the size of inserting paper (A4, A4R, B4, or A3) is selected (FIG. 15). FIG. 15 shows that "A4" size is selected. After the paper feeding position and paper size of inserting paper have been selected, setting of the inserter 320 by the insertion apparatus selection unit 905 is complete.

(Selection of Limitation on Post-Processing Apparatuses)

Selection of limitation on post-processing apparatuses will be described below. When setting of the inserter 320 is complete, the screen of the display portion 620 returns to the application mode selection screen shown in FIG. 16. If the operator subsequently selects a post-processing function he wants to use, selection of post-processing apparatuses is limited by the post-processing apparatus limitation selection unit 902.

Figure 16:
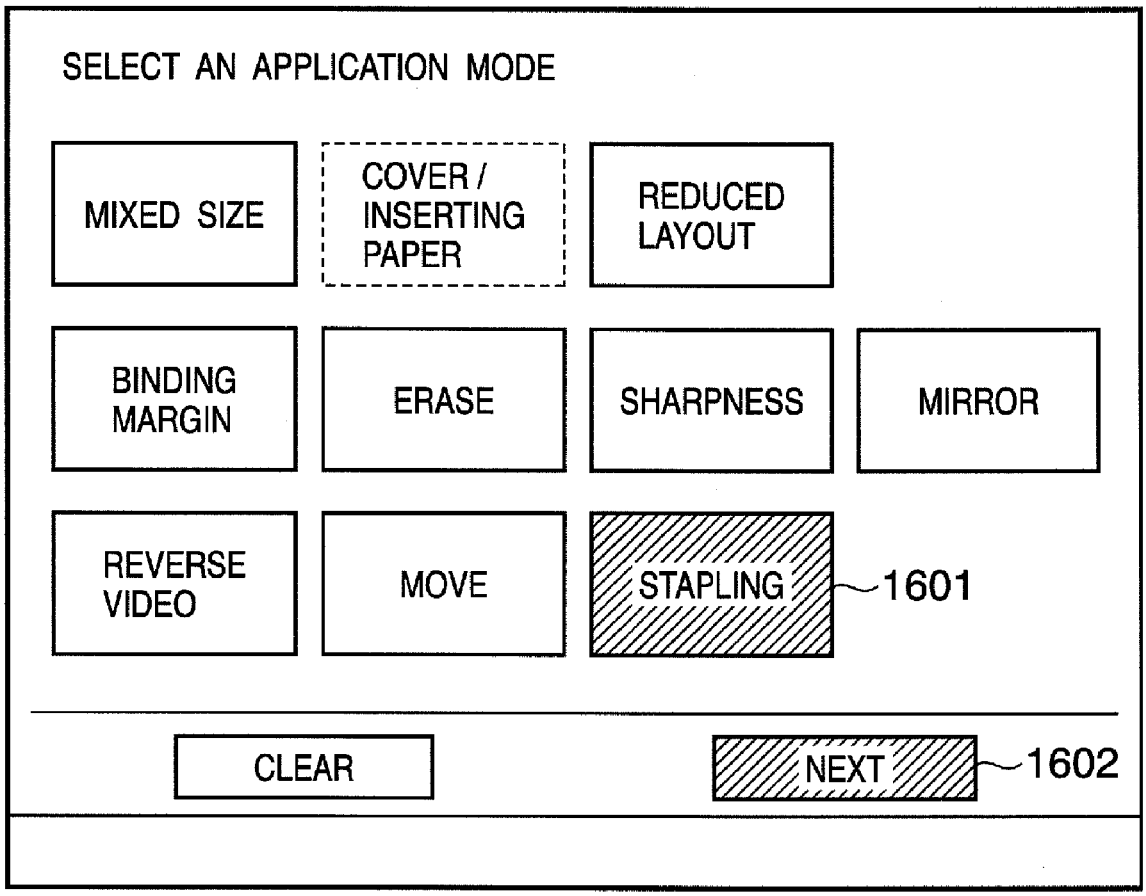
FIG. 16 shows a screen for selecting an application mode.
Figure 17:
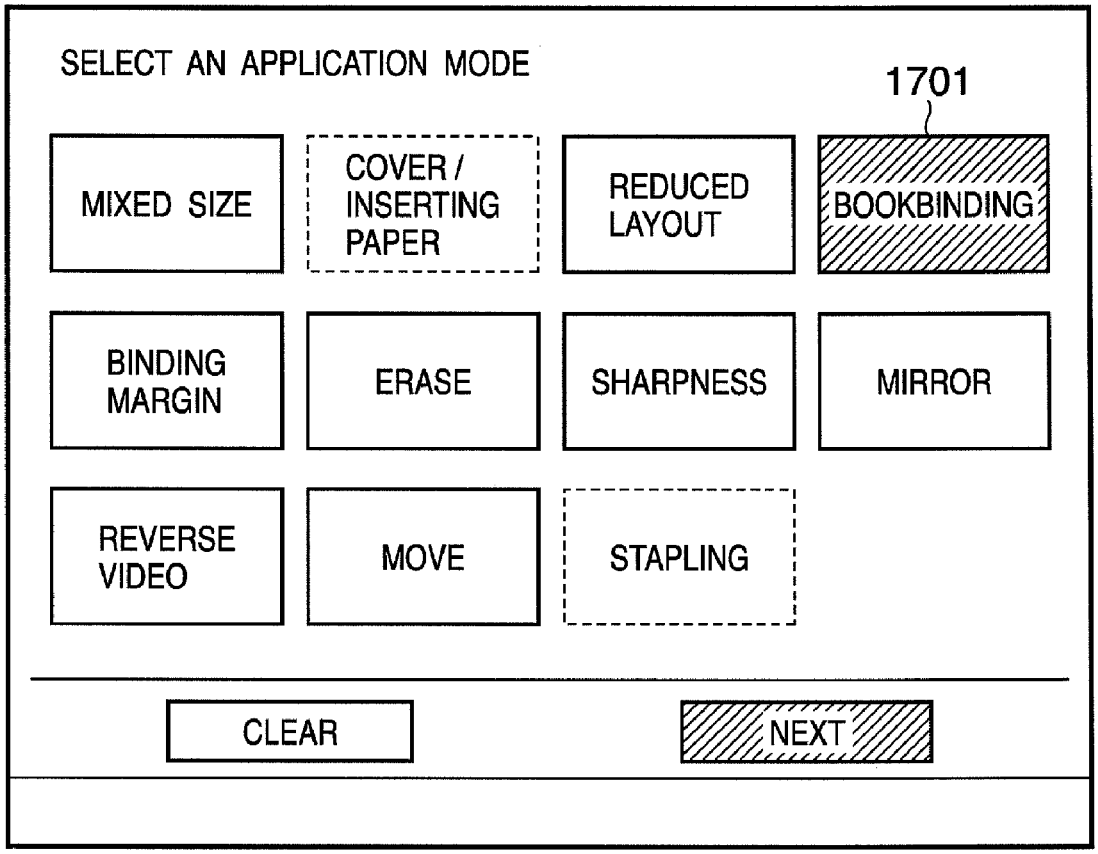
FIG. 17 shows a screen for selecting an application mode.

At S1012, a list of functions of selectable post-processing apparatuses is displayed on the screen (FIGS. 16 and 17). This display of the list is based on the result of processing by the post-processing apparatus limitation selection unit 902.

(Processing at the Post-Processing Apparatus Limitation Selection Unit 902)

Figure 24:
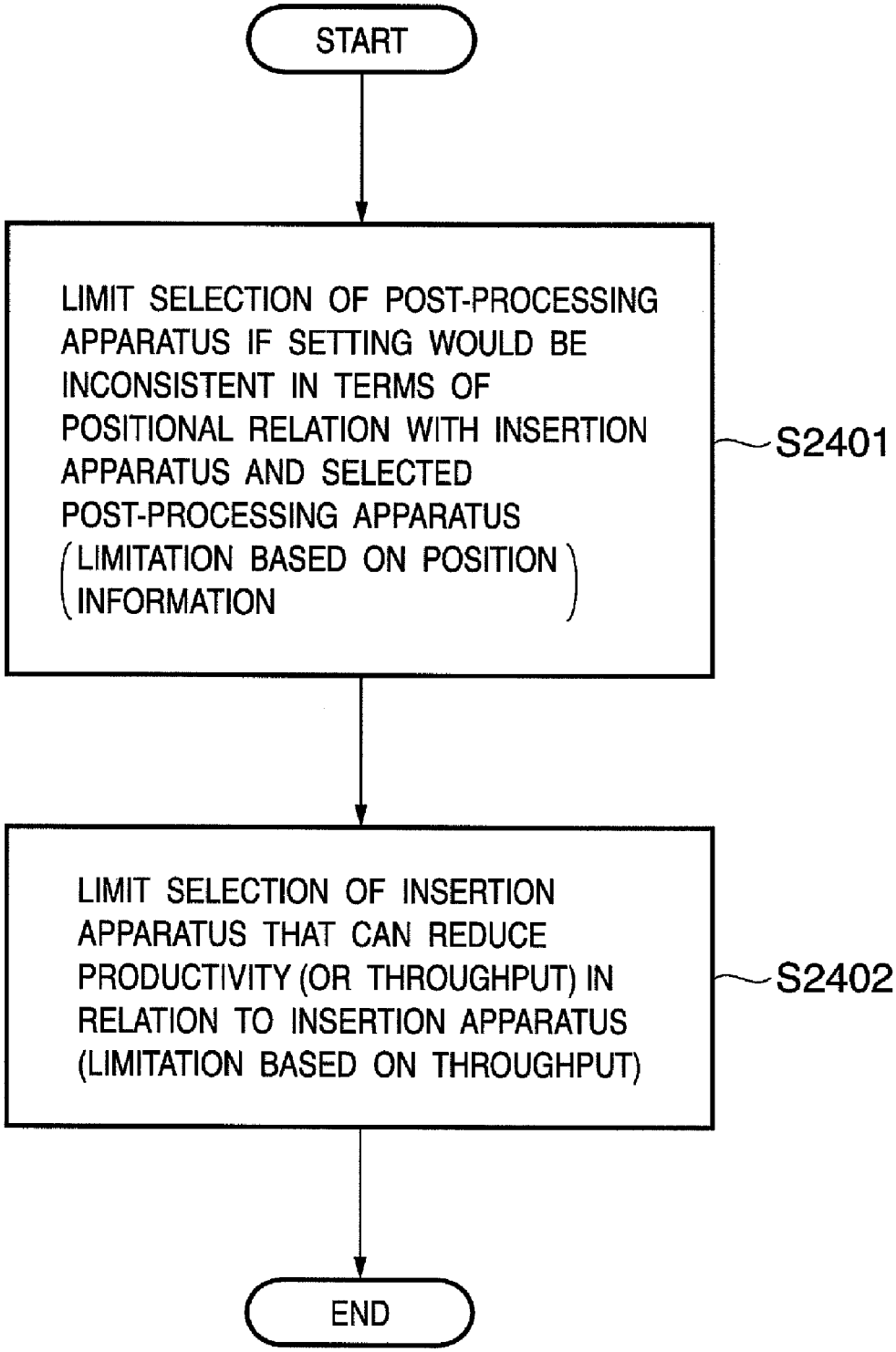
FIG. 24 is a flowchart illustrating processing at the post-processing apparatus limitation selection unit 902.

The post-processing apparatus limitation selection unit 902 executes processing for selecting limitation on post-processing apparatuses in accordance with the flowchart of FIG. 24.

At step S2401, if setting would be inconsistent in positional relation between an insertion apparatus and the selected post-processing apparatus, the post-processing apparatus limitation selection unit 902 limits selection of the post-processing apparatus (i.e., limitation based on position information).

Next, at step S2402, the post-processing apparatus limitation selection unit 902 limits selection of any post-processing apparatus that can reduce productivity (throughput) in relation to the insertion apparatus with reference to throughput data for each of the post-processing apparatuses.

FIG. 27A shows a result of selection limitation based on processing at S2401 of FIG. 24. When the inserter 320 of the insertion dedicated apparatus (IDO) is selected in the positional relation shown in FIG. 22A, selection of a post-processing apparatus that is positioned downstream from the inserter 320 will not result in physically inconsistent setting. In this case, selection of the insertion dedicated apparatus 300, bookbinding apparatus 500, and finishing apparatus 700 is thus not limited.

FIG. 27B shows an example of throughput data for each post-processing apparatus when the insertion apparatus is of the insertion dedicated apparatus 300. It is possible to evaluate productivity for combination of the selected insertion apparatus and a post-processing apparatus based on throughput data, and limitation of selection at S2402 of FIG. 24 is executed based on the data.

In FIG. 27B, relative to the inserter 320, the throughput of the insertion dedicated apparatus 300 and finishing apparatus 700 is "A (high level)", thus throughput would not be reduced with combination of either of them and the inserter 320. The post-processing apparatus limitation selection unit 902 identifies the insertion dedicated apparatus 300 and finishing apparatus 700 as selectable apparatuses.

Meanwhile, in FIG. 27B, the bookbinding apparatus has throughput of "B (medium level)", thus has lower throughput. If the bookbinding apparatus 500 is selected in combination with the inserter 320, it can reduce throughput at the inserter 320. In this case, the post-processing apparatus limitation selection unit 902 limits selection of the bookbinding apparatus 500. This can limit selection that can result in reduced productivity (throughput).

Based on processing by the post-processing apparatus limitation selection unit 902, the application mode selection screen shown in FIG. 16 does not show indication corresponding to "bookbinding" 1204, which is a function provided by the bookbinding apparatus and is present on the application mode selection screen of FIG. 12, thereby limiting selection of "bookbinding" function. The screen shown in FIG. 16 for selecting a post-processing apparatus (function) shows that "stapling" function, which is a function provided by the finishing apparatus, is selected (1601, S1013).

(When the Inserter 520 Attached in the Bookbinding Apparatus is Selected)

Figure 21:
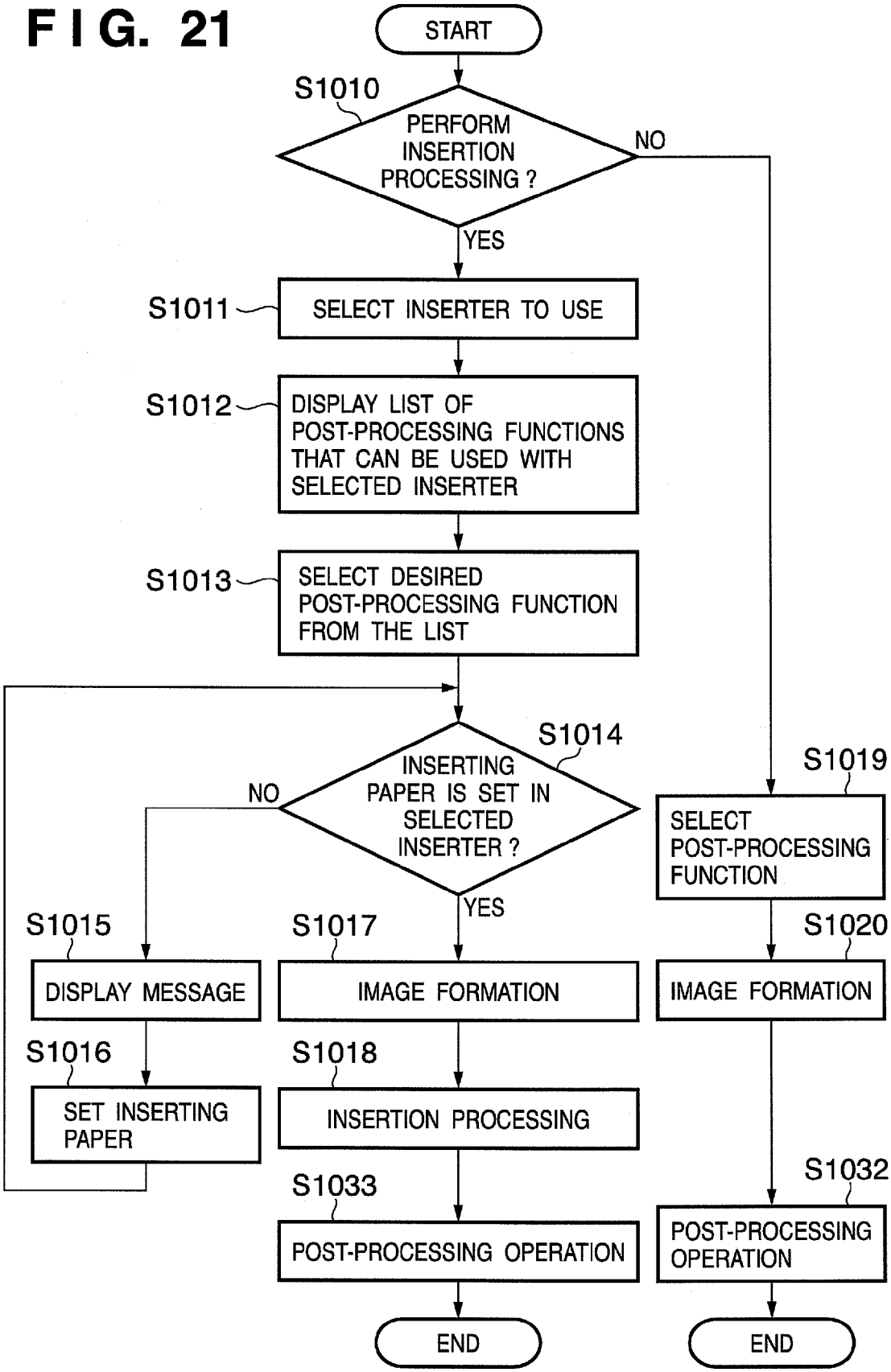
FIG. 21 is flowchart illustrating procedure of operation flow 2.

The following will describe a case where the inserter 520 that is provided in the bookbinding apparatus is selected at step S1011 of FIG. 21 (S1011). When the inserter 520 of the bookbinding apparatus is selected (1303) and "Next" 1302 is pressed on the selection screen of FIG. 13, the display changes to the screen for selecting a paper feeding position (FIG. 14) at which inserting paper is fed among sheets. After a paper feeding position is selected ("front cover" is selected in FIG. 14), the size of inserting paper is selected next (FIG. 15). When paper feeding position and the size of inserting paper have been selected, setting of the inserter 520 by the insertion apparatus selection unit 905 is complete.

(Selection of Limitation on Post-Processing Apparatuses)

When setting of the inserter 520 is complete, the screen on the display portion 620 returns to the application mode selection screen shown in FIG. 17. If the operator subsequently selects a post-processing function he wants to use, the post-processing apparatus limitation selection unit 902 limits selection of a post-processing apparatus.

FIG. 28A shows an exemplary result of selection limitation based on processing at S2401 of FIG. 24. For example, when the inserter 520 of the bookbinding apparatus (ID3) is selected in the positional relation shown in FIG. 22A, setting would not be physically inconsistent if the bookbinding apparatus 500 and the finishing apparatus that is positioned downstream from the bookbinding apparatus 500 are selected. Thus, selection of the bookbinding apparatus 500 and finishing apparatus 700 is not limited.

However, selection of the insertion dedicated apparatus that is positioned upstream of the bookbinding apparatus 500 as a post-processing apparatus would be a physically inconsistent setting, thus selection of it is limited. This limitation of selection can prevent operation error that leads to an inconsistent setting.

FIGS. 28B and C show exemplary throughput data for each post-processing apparatus when the insertion apparatus is of the bookbinding apparatus 500. It is possible to evaluate productivity in combination of the selected insertion apparatus and a post-processing apparatus based on throughput data, and limitation of selection at S2402 of FIG. 24 is executed based on the data.

In FIG. 28B, relative to the inserter 520, the throughput of the bookbinding apparatus 500 and finishing apparatus 700 is "A" (high level), thus reduction of throughput would not occur with combination of either of them and the inserter 520. In this case, the post-processing apparatus limitation selection unit 902 identifies the bookbinding apparatus 500 and the finishing apparatus 700 as selectable apparatuses.

On the other hand, in FIG. 28C, the finishing apparatus 700 has throughput of "B (medium level)", thus has lower throughput. Selection of the finishing apparatus 700 in combination with the inserter 520 may reduce throughput of the inserter 520. In the case shown in FIG. 28C, the post-processing apparatus limitation selection unit 902 limits selection of the finishing apparatus 700. This can limit selection that can result in reduced productivity (throughput).

From FIGS. 28A and C, the post-processing apparatus limitation selection unit 902 identifies the bookbinding apparatus 500 as a selectable apparatus.

In this case, the application mode selection screen shown in FIG. 17 does not show display corresponding to "stapling" 1205, which is a function provided by the finishing apparatus and is present on the application mode selection screen in FIG. 12, thereby limiting selection of the finishing apparatus 700.

The screen for selecting a post-processing apparatus (function) in FIG. 17 shows that "bookbinding", which is a function of the bookbinding apparatus, is selected as a post-processing function (1701).

Figure 18:
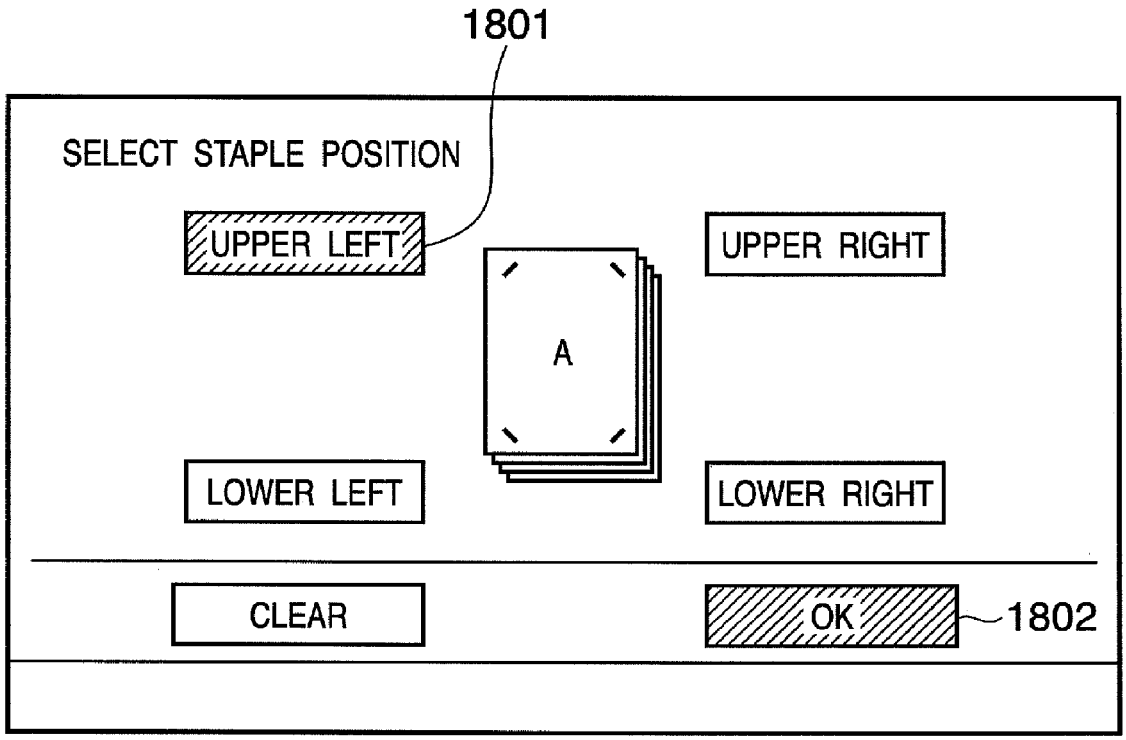
FIG. 18 shows a screen for selecting a stapling position.
Figure 19:
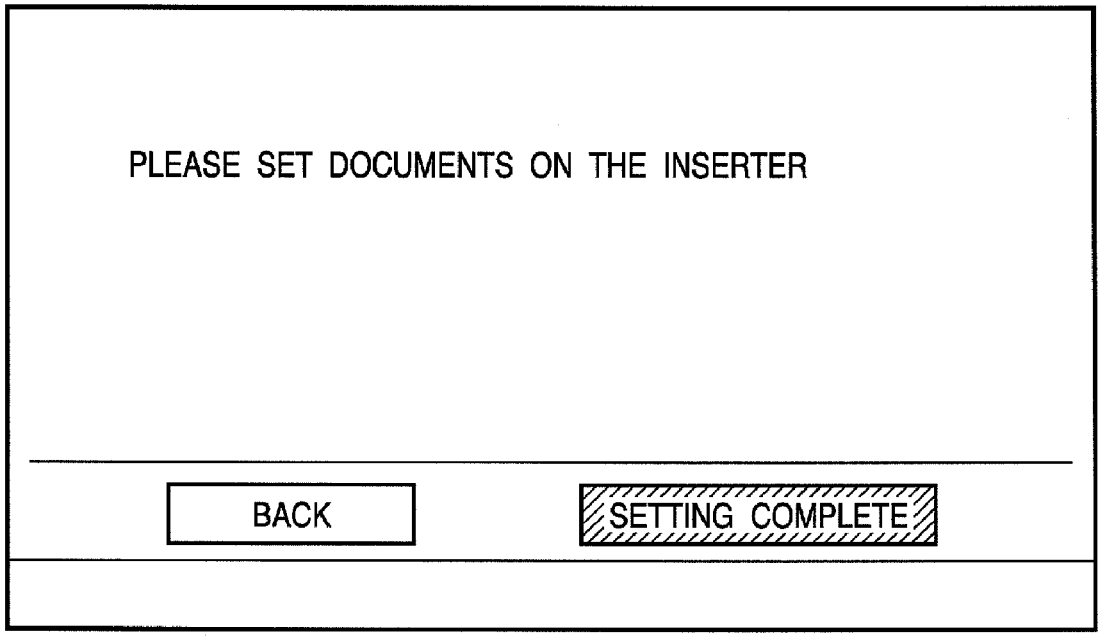
FIG. 19 shows an example of a warning message displayed on the display.

When "bookbinding" function is selected in FIG. 17, the screen is switched to that shown in FIG. 18, that is, a screen for selecting stapling position (FIG. 18). In FIG. 18, "upper left" 1801 is selected. When "OK" button 1802 is pressed, setting of the post-processing apparatus (function) is complete (S1013).

(Preparation of Inserting Paper)

Returning to FIG. 21, at step S1013, when setting of the post-processing apparatus (function) is complete, the CPU 153 determines whether inserting paper is already set in the selected insertion apparatus (81014).

If inserting paper is not set in the insertion apparatus (No at S1014), the operation display device control unit 901 has the operation display device 600 display a message that prompts the operator to set inserting paper in the selected insertion apparatus (FIG. 19) (S1005)

When the operator sets inserting paper (S1016) and presses the start key 602 on the operation display device 600, the preparation is complete (YES at S1014) and processing proceeds to step S1017.

However, if inserting paper has been set at the point processing proceeds from step S1013 to step S1014 (YES at S1014), processing proceeds to step S1017.

At step S1017, the image forming apparatus executes image formation processing; at step S1018, insertion processing is executed by the selected insertion apparatus; and, at step S1033, operation of the selected post-processing is executed. With the processing, the operation flow 2 terminates.

According to the embodiment, it is possible to provide an image formation technique that can prevent operation error, has high productivity, and enables operation of a image forming system with flexibility.

It is also possible to provide an image forming system that can limit selection of a post-processing apparatus that would be limited in use in relation to an insertion apparatus selected from a plurality of insertion apparatuses and enables selection of an available post-processing apparatus.

Other Embodiments

It goes without saying that the object of the present invention may also be accomplished by supplying a system or an apparatus with a storage medium storing thereon a program code of software which realizes the functions of the above described embodiment. The object of the invention may also be accomplished by a computer (or CPU or MPU) of the system or apparatus reading out the program code stored in the storage medium and executing the same.

In this case, the program code itself read out from the storage medium realizes the functions of the above described embodiment and hence the storage medium storing the program code constitutes the present invention.

The storage medium for supplying the program code may be a flexible disk, hard disk, optical disk, magneto-optical disk, CD-ROM, CD-R, non-volatile memory card and ROM.

Through execution of the program code read out by the computer, the functions of the above described embodiment are realized. A case is also encompassed where an operating system (OS) running on the computer executes some or all of actual processing in accordance with instructions of the program code so as to realize the above described embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-258306, filed Sep. 6, 2005, which is hereby incorporated by reference herein in its entirety.

What is claimed is:

1. An image forming system comprising:

an image forming apparatus;

a plurality of post-processing apparatuses that post process recording media discharged from said image forming apparatus, wherein the plurality of post-processing apparatuses are serially arranged downstream of the image forming apparatus and provide a common conveying path that extends from the image forming apparatus;

a plurality of inserting apparatuses that supply inserting media to the plurality of post-processing apparatuses, wherein each of the plurality of inserting apparatuses is adapted to convey an inserting medium into the common conveying path, with the inserting media conveyed from the respective inserting apparatuses being insertable at different positions along the common conveying path;

a first selection unit adapted to select a post-processing apparatus among the plurality of post-processing apparatuses;

a second selection unit adapted to select at least one of the plurality of inserting apparatuses for supplying the inserting media; and a selection limitation unit adapted to limit, based on each position of the plurality of post-processing apparatuses and different insertion positions at which the plurality of inserting apparatuses insert the insertion media to the common conveying path, a combination of the post-processing apparatus selected by the first selection unit and the at least one of the plurality of inserting apparatus selected by the second selection unit.

2. The image forming system according to claim 1, wherein said selection limitation unit prevents a selection of one of the post-processing apparatuses and one of the inserting apparatuses that would insert the insertion medium into the common conveying path, downstream from the selected one post-processing apparatus.

3. The image forming system according to claim 1, further comprising:

a throughput evaluation unit adapted to evaluate throughput for the combination of each of the plurality of post-processing apparatuses and each of the plurality of inserting apparatuses, wherein the selection limitation unit prevents selection of any of the plurality of inserting apparatuses that reduces throughput of the selected post-processing apparatus based on evaluation by said throughput evaluation unit.

4. The image forming system according to claim 1, further comprising a display control unit adapted to have a display unit display any of the plurality of inserting apparatuses that is not prevented from being selected by said selection limitation unit as a selectable inserting apparatus, in a case where the first selection unit selects one of the plurality of post-processing apparatuses before the second selection unit selects at least one of the plurality of inserting apparatuses.

5. A control method for an image forming system comprising an image forming apparatus and a plurality of post-processing apparatuses that post process recording media discharged from said image forming apparatus, wherein the plurality of post-processing apparatuses are serially arranged downstream of the image forming apparatus and provide a common conveying path that extends from the image forming apparatus, and a plurality of insertion apparatuses that supply inserting media to the plurality of post-processing apparatuses, wherein each of the plurality of inserting apparatuses is adapted to convey an inserting medium into the common conveying path, with the inserting media conveyed from the respective inserting apparatuses being insertable at different positions along the common conveying path, said method comprising:

a first selection step of selecting a post-processing apparatus among the plurality of post-processing apparatuses;

a second selection step of selecting at least one of the plurality of inserting apparatuses for supplying the inserting media to the selected post-processing apparatus;

a selection limitation step of limiting, based on each position of the plurality of post-processing apparatuses and different insertion positions at which the plurality of inserting apparatuses insert the insertion media to the common conveying path, a combination of the post-processing apparatus selected in the first selection step and the at least one inserting apparatus selected in the second selection step.

6. An image forming system comprising:

an image forming apparatus;

a plurality of post-processing apparatuses that execute a post-processing to recording media discharged from said image forming apparatus, wherein the plurality of post-processing apparatuses are serially arranged downstream of the image forming apparatus and provide a common conveying path that extends from the image forming apparatus;

a plurality of inserting apparatus for supplying inserting media to the plurality of post-processing apparatuses, wherein each of the plurality of inserting apparatuses is adapted to convey an inserting medium into the common conveying path, with the inserting media conveyed from the respective inserting apparatuses being insertable at different positions along the common conveying path;

a selection unit adapted to select a post-processing apparatus among a plurality of post-processing apparatuses;

a mode selection unit adapted to select a mode for using the inserting medium;

a determination unit adapted to determine, in a case where the mode is selected by said mode selection unit, at least one of the plurality of inserting apparatuses appropriate for the selected post-processing apparatus.

7. The image forming system according to claim 6, further comprising a display unit adapted to display, as a selection candidate, the at least one inserting apparatus determined by said determination unit.

8. The image forming system according to claim 6, wherein said determination unit determines, as a suitable inserting apparatus, among the plurality of inserting apparatuses, at least one inserting apparatus other than an inserting apparatus positioned downstream from the selected post-processing apparatus based on each positional relation of the selected post-processing apparatus and the plurality of inserting apparatuses.

9. The image forming system according to claim 6, wherein said determination unit determines, as a selectable inserting apparatus, among the plurality of inserting apparatuses, at least one inserting apparatus that does not reduce throughput of the selected post-processing apparatus based on each throughput of the selected post-processing apparatus and the plurality of inserting apparatuses.

10. The image forming system according to claim 6, further comprising:

a function selection unit adapted to select a post-processing function, wherein said selection unit selects one of the plurality of post-processing apparatuses that executes the post-processing function selected by said function selection unit.

* * * * *